US008663882B2

(12) United States Patent
Mitsumori et al.

(10) Patent No.: US 8,663,882 B2
(45) Date of Patent: Mar. 4, 2014

(54) ELECTROPHOTOGRAPHIC PHOTOSENSITIVE BODY, IMAGE-FORMING DEVICE USING SAME AND CARTRIDGE

(75) Inventors: Teruyuki Mitsumori, Yokohama (JP); Masayuki Hiroi, Yokohama (JP); Hiroaki Takamura, Yokohama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 1251 days.

(21) Appl. No.: 12/088,322

(22) PCT Filed: Sep. 28, 2006

(86) PCT No.: PCT/JP2006/319308

§ 371 (c)(1),
(2), (4) Date: Mar. 27, 2008

(87) PCT Pub. No.: WO2007/037331

PCT Pub. Date: Apr. 5, 2007

(65) Prior Publication Data

US 2010/0150608 A1 Jun. 17, 2010

(30) Foreign Application Priority Data

Sep. 28, 2005 (JP) ..... 2005-282810
Sep. 28, 2005 (JP) ..... 2005-282811

(51) Int. Cl.
*G03G 15/02* (2006.01)
*G03G 15/00* (2006.01)

(52) U.S. Cl.
USPC ..... 430/58.65; 430/58.7; 430/58.75; 430/58.8; 430/58.85

(58) Field of Classification Search
USPC ..... 430/58.65, 58.75, 58.7, 58.8, 58.85
See application file for complete search history.

(56) References Cited

U.S. PATENT DOCUMENTS 4,606,988 A 8/1986 Sasaki
4,777,296 A 10/1988 Sasaki (Continued)

FOREIGN PATENT DOCUMENTS

JP 60-175052 9/1985
JP 4-292663 A 10/1992

(Continued)

OTHER PUBLICATIONS

Machine translation of JP 9-34142.*

(Continued)

*Primary Examiner* — Thorl Chea
(74) *Attorney, Agent, or Firm* — Oblon, Spivak, McClelland, Maier & Neustadt, L.LP.

(57) ABSTRACT

To provide an electrophotographic photoreceptor excellent in electric characteristics and various characteristics, capable of forming a uniform photosensitive layer and excellent in repetitive characteristics, an image forming apparatus using it and an electrophotgraphic cartridge.

A lamination type electrophotographic photoreceptor comprising an electroconductive substrate and a photosensitive layer formed thereon, characterized in that the photosensitive layer contains a compound represented by the following formula (1), the ratio of the weight of the compound represented by the formula (1) to the weight content of all binder resins contained in the photosensitive layer is from 0.15 to 0.6, and the weight of the compound represented by the formula (1) is maximum among all charge transport materials:

(1)

wherein each of $Ar^1$, $Ar^2$ and $Ar^3$ is an aryl group which may have a substituent, each of $Ar^4$ and $Ar^5$ which are independent of each other, is an arylene group which may have a substituent, and each of $n^1$ and $n^2$ which are independent of each other, is an integer of from 1 to 3.

23 Claims, 1 Drawing Sheet

(56) References Cited

U.S. PATENT DOCUMENTS

| | | | | |
|---|---|---|---|---|
| 5,932,384 | A | 8/1999 | Mitsumori et al. | |
| 7,175,954 | B2 | 2/2007 | Sakimura et al. | |
| 2002/0081508 | A1* | 6/2002 | Horiuchi et al. | 430/59.5 |
| 2003/0224270 | A1* | 12/2003 | Mitsumori et al. | 430/96 |
| 2005/0008957 | A1* | 1/2005 | Ikegami et al. | 430/56 |
| 2007/0054209 | A1 | 3/2007 | Azuma et al. | |

FOREIGN PATENT DOCUMENTS

| | | | |
|---|---|---|---|
| JP | 6-27702 | A | 2/1994 |
| JP | 6 75397 | | 3/1994 |
| JP | 6-110224 | | 4/1994 |
| JP | 9-34142 | | 2/1997 |
| JP | 9 34142 | | 2/1997 |
| JP | 10-20514 | | 1/1998 |
| JP | 10 69104 | | 3/1998 |
| JP | 10-312071 | | 11/1998 |
| JP | 2001 242645 | | 9/2001 |
| JP | 2002-80432 | A | 3/2002 |
| JP | 2003-131409 | A | 5/2003 |
| JP | 2004 246120 | | 9/2004 |
| JP | 2004-252066 | | 9/2004 |
| JP | 2004-302032 | | 10/2004 |
| JP | 2005 134709 | | 5/2005 |
| JP | 2005 181679 | | 7/2005 |
| JP | 2005-221539 | A | 8/2005 |
| JP | 2005-289877 | | 10/2005 |
| JP | 2005 289877 | | 10/2005 |
| JP | 2006-126672 | | 5/2006 |
| JP | 2006-178321 | | 7/2006 |
| JP | 2006-284679 | | 10/2006 |
| JP | 2007-102199 | | 4/2007 |
| JP | 2008-9139 | | 1/2008 |

OTHER PUBLICATIONS

Machine translation of JP 2001-242645.*

Machine Translation of JP2002-080432.*

Japanese Office Action issued on Apr. 19, 2011 in corresponding Japanese Application No. 2006-263952 (with an English Translation).

Office Action issued Oct. 4, 2011, in Japanese Patent Application No. 2011-132514 with English translation.

* cited by examiner

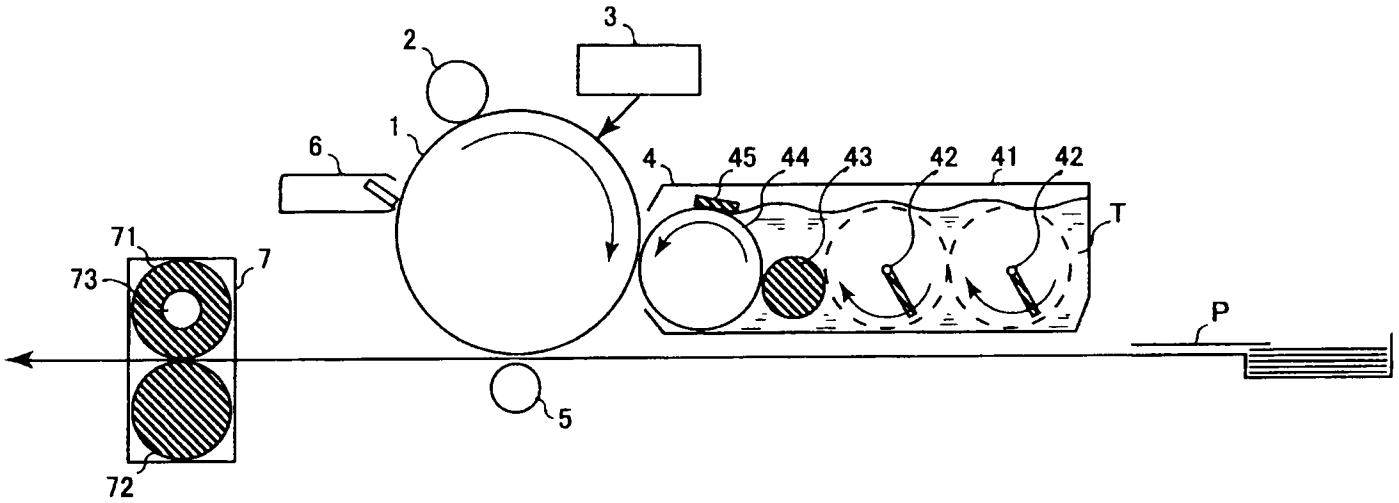
P
T
42
41
42
43
44
45
4
3
2
1
6
5
7
71
73
72

ELECTROPHOTOGRAPHIC PHOTOSENSITIVE BODY, IMAGE-FORMING DEVICE USING SAME AND CARTRIDGE

TECHNICAL FIELD

The present invention relates to an electrophotographic photoreceptor comprising an electroconductive substrate and a photosensitive layer formed thereon. More particularly, it relates to an electrophotographic photoreceptor having favorable electric characteristics, stability and durability, an image forming apparatus using the photoreceptor and an electrophotographic cartridge.

BACKGROUND ART

An electrophotographic technology has found widespread applications in the field of not only copying machines but also various printers and printing machines in recent years because it can provide an image of immediacy and high quality.

As for the photoreceptor which is the core of the electrophotographic technology, use of photoreceptors using organic photoconductive materials having advantages of retaining no pollution, ensuring easy film-forming, being easy to manufacture, and the like, has been the main stream in recent years instead of conventional inorganic photoconductive materials such as selenium, an arsenic-selenium alloy, cadmium sulfide or zinc oxide.

As the layer structure of the organic photoreceptor, there are known a so-called monolayer type photoreceptor obtained by dispersing a charge generation material in a binder resin, and a lamination type photoreceptor obtained by laminating a charge generation layer and a charge transport layer. The lamination type photoreceptor has been widely used because a stable high sensitivity photoreceptor can be provided by combining optimum layers of a charge generation material and a charge transport material each having a high efficiency, and characteristics are easily adjusted because of its wide material selection range. The monolayer type photoreceptor is slightly inferior to the lamination type photoreceptor in view of electric characteristics and its narrow material selection range, and accordingly has been is used to a limited extent. Further, the electrophotographic photoreceptor is repeatedly used in an electrophotographic process, i.e., in cycles of charging, exposure, development, transfer, cleaning, charge removal, and the like, during which it is subjected to various stress to be deteriorated. Among them, the chemical deterioration may be a damage to a photosensitive layer by strongly oxidizing ozone or NOx risen from, for example, a corona charger commonly used as a charger, and when repeatedly used, deterioration of electrical stability such as a reduction in the triboelectricity and an increase in the residual potential and accompanying image failure may occur. These are greatly due to chemical deterioration of a charge transport material contained in a large amount in the photosensitive layer.

Further, high sensitivity and high responsibility are required along with speeding up of the electrophotographic process in recent years. Among them, for high sensitivity, not only optimization of the charge generation material but also development of a charge transport material having favorable characteristics when combined with the charge generation material has been required, and for high responsibility, development of a is charge transport material having high mobility and showing a sufficiently low residual potential at the time of exposure has been required. As a charge transport material effective for high sensitivity and high responsibility, charge transport materials using various butadiene skeletons have been known (e.g. Patent Documents 1 to 3).

Patent Document 1: JP-A-60-175052

Patent Document 2: JP-A-10-312071

Patent Document 3: JP-A-2004-302032

DISCLOSURE OF THE INVENTION

Object to be Accomplished by the Invention

It is possible to achieve high sensitivity and high responsibility in many cases by increasing the content of the charge transport material relative to the binder resin, but mechanical strength decreases in many cases, thus decreasing durability such as printing resistance and scar resistance. Accordingly, an electrophotographic photoreceptor which can achieve high sensitivity and high responsibility even with a content of the charge transport material to such an extent that the durability will not be decreased has been desired, and a technology of applying the charge transport materials disclosed in the above documents has been known. However, there is such a problem that it is difficult to form a uniform photosensitive layer by such a technology, and there are problems such that the photosensitive layer is clouded by insoluble components, thus deteriorating electric characteristics, by long-term storage, storage in cold climates, long-term use or the like of the photoreceptor. Further, a photoreceptor by the technology disclosed in the above documents is weak against an oxidizing material such as ozone, and its characteristics will deteriorate when repeatedly used in the interior of an image forming apparatus (electrophotographic apparatus).

The present invention has been accomplished under these circumstances. Namely, the present invention is to provide an electrophotographic photoreceptor excellent in electric characteristics and various characteristics, capable of forming a uniform photosensitive layer and excellent also in repetitive characteristics, an image forming apparatus using the electrophotographic photoreceptor and an electrophotographic cartridge.

Means to Accomplish the Object

The present inventors have conducted extensive studies on a charge transport material which meets the above requirements and as a result, they have found that electric characteristics, stability and durability of an electrophotographic photoreceptor are improved by using a charge transport material having a specific structural formula in a certain constant number of parts, and accomplished the present invention.

Namely, the present invention provides the following.

(1) An electrophotographic photoreceptor which is a lamination type electrophotographic photoreceptor comprising an electroconductive substrate and a photosensitive layer formed thereon, characterized in that the photosensitive layer contains a compound represented by the following formula (1), the ratio of the weight of the compound represented by the formula (1) to the weight content of all binder resins contained in the photosensitive layer is from 0.15 to 0.6, and the weight of the compound represented by the formula (1) is maximum among all charge transport materials:

(1)

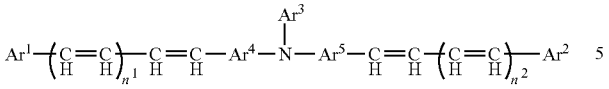

wherein each of $Ar^1$, $Ar^2$ and $Ar^3$ is an aryl group which may have a substituent, each of $Ar^4$ and $Ar^5$ which are independent of each other, is an arylene group which may have a substituent, and each of $n^1$ and $n^2$ which are independent of each other, is an integer of from 1 to 3.

(2) An electrophotographic photoreceptor comprising an electroconductive substrate and a photosensitive layer formed thereon, characterized in that the photosensitive layer contains a compound represented by the above formula (1), the ratio of the weight of the compound represented by the formula (1) to the weight content of all binder resins contained in the photosensitive layer is from 0.15 to 0.9, the weight of the compound represented by the formula (1) is maximum among all charge transport materials, and the photosensitive layer contains oxytitanium phthalocyanine.

(3) An electrophotographic photoreceptor comprising an electroconductive substrate and a photosensitive layer formed thereon, characterized in that the photosensitive layer contains a compound represented by the above formula (1), $Ar^3$ in the compound represented by the formula (1) has a plurality of alkyl substituents, and the photosensitive layer contains oxytitanium phthalocyanine.

(4) An electrophotographic photoreceptor comprising an electroconductive substrate and a photosensitive layer formed thereon, characterized in that the photosensitive layer contains a compound represented by the above formula (1), $Ar^3$ in the compound represented by the formula (1) has an alkyl group having at least two carbon atoms as a substituent, and the photosensitive layer contains oxytitanium phthalocyanine.

(5) An electrophotographic photoreceptor comprising an electroconductive substrate and a photosensitive layer formed thereon, characterized in that the photosensitive layer contains a compound represented by the above formula (1) and a polyarylate.

(6) An electrophotographic photoreceptor comprising an electroconductive substrate and a photosensitive layer formed thereon, characterized in that the photosensitive layer contains a compound represented by the above formula (1) and a polycarbonate having the following structural units (p-1):

(p-1)

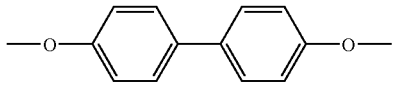

(7) An electrophotographic photoreceptor comprising an electroconductive substrate and a photosensitive layer formed thereon, characterized in that the photosensitive layer contains a compound represented by the above formula (1) and a polycarbonate having the following structural units (p-2), and the ratio of the weight of the compound represented by the formula (1) to the weight content of all binder resins in the photosensitive layer is from 0.15 to 0.9:

(p-2)

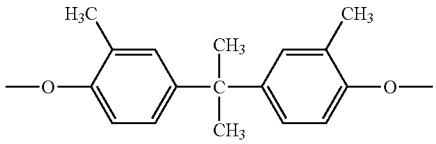

(8) An electrophotographic photoreceptor comprising an electroconductive substrate and a photosensitive layer formed thereon, characterized in that the photosensitive layer contains a compound represented by the above formula (1), and the electroconductive substrate is made of aluminum or an aluminum alloy and has an anodic oxide film.

(9) An electrophotographic photoreceptor comprising an electroconductive substrate and a photosensitive layer formed thereon, characterized in that the photosensitive layer contains a compound represented by the above formula (1), and an undercoat layer is provided between the electroconductive substrate and the photosensitive layer.

(10) An electrophotographic photoreceptor comprising an electroconductive substrate and a photosensitive layer formed thereon, characterized in that the photosensitive layer contains a compound represented by the above formula (1) and a charge transport material represented by the following formula (r):

(r)

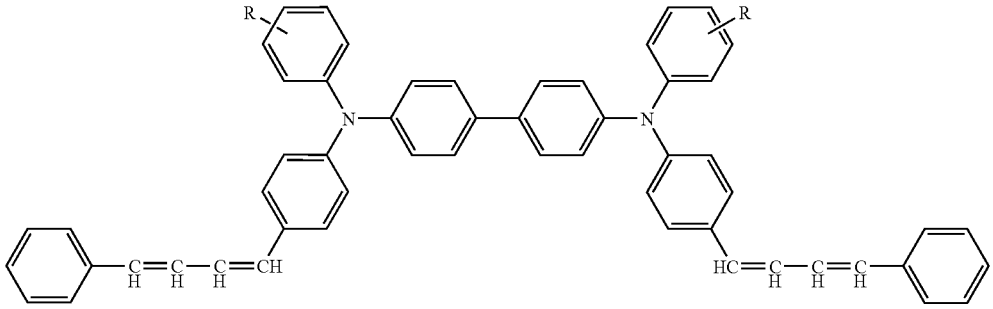

wherein each of R's which may be different from each other, is a hydrogen atom, an alkyl group, an alkoxy group or a phenyl group.

(11) An electrophotographic photoreceptor comprising an electroconductive substrate and a photosensitive layer formed thereon, characterized in that the photosensitive layer contains a compound represented by the above formula (1) and at least one charge transport material selected from the group consisting of compounds of the following formulae (p) and (q), and the ratio of the weight of the compound represented by the formula (1) to the weight content of all binder resins in the photosensitive layer is from 0.15 to 0.9:

(p)

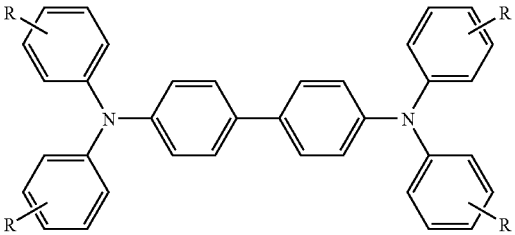

(q)

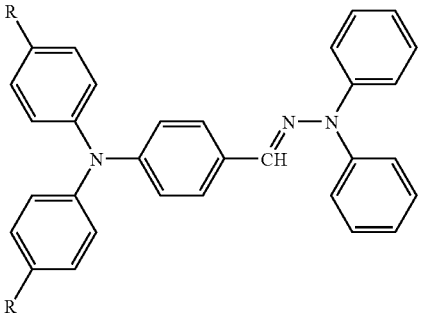

wherein each of R's which may be different from each other, is a hydrogen atom, an alkyl group, an alkoxy group or a phenyl group.

(12) An electrophotographic photoreceptor comprising an electroconductive substrate and a photosensitive layer formed thereon, characterized in that the photosensitive layer contains a compound represented by the above formula (1), and the electrophotographic photoreceptor is charged by a charger of contact charging system.

(13) An image forming apparatus using the electrophotographic photoreceptor as defined in any one of the above (1) to (12).

(14) An electrophotographic cartridge having the electrophotographic photoreceptor as defined in any one of the above (1) to (12).

Effects of the Invention

By use of the charge transport material of the present invention, it is possible to provide an electrophotographic photoreceptor excellent in electric characteristics and having favorable stability and durability, an image forming apparatus using the photoreceptor, and an electrophotographic cartridge.

More specifically, an electrophotographic photoreceptor applicable to electrophotographic apparatus such as high quality printers, facsimiles and copying machines can be provided. Further, a photoreceptor with small fluctuations in electric characteristics by environmental fluctuation, particularly, excellent in repetitive characteristics at high temperature under high humidity and excellent in mechanical durability and further, excellent in printing resistance, can be obtained. Further, it is characterized by high mobility.

BRIEF DESCRIPTION OF THE DRAWING

FIG. 1 is a drawing illustrating one example of an image forming apparatus of the present invention.

MEANING OF SYMBOLS

1. Electrophotographic photoreceptor
2. Charging apparatus (charging roller)
3. Exposure apparatus
4. Developing apparatus
5. Transfer apparatus
6. Cleaning apparatus
7. Fixing apparatus
41. Developing tank
42. Agitator
43. Supply roller
44. Developing roller
45. Control member
71. Upper fixing member
72. Lower fixing member
73. Heating apparatus
T Toner
P Recording medium

Best Mode for Carrying Out the Invention

Now, the present invention will be described in detail with reference to the preferred embodiments. However, the present invention is by no means restricted to the following description, and various changes and modifications can be made without departing from the spirit and scope of the present invention.

(Electrophotographic Photoreceptor)

The structure of the electrophotographic photoreceptor of the present invention is not particularly limited so long as a photosensitive layer is formed on an electroconductive substrate. As the structure of the photosensitive layer, a so-called lamination type photoreceptor in which functions of charge generation and charge transport are separated and a charge generation layer and a charge transport layer are laminated, and a so-called monolayer type photoreceptor in which a charge generation material and a charge transport material are contained in a single layer, have been commonly employed. Further, as the layer structure of the lamination type photoreceptor, an obverse lamination type photosensitive layer having a charge transport layer and a charge generation layer laminated in this order from the electroconductive substrate side and a reverse lamination type photosensitive layer having them reversely laminated, have been known. For the electrophotographic photoreceptor of the present invention, any of these photosensitive layers may be employed.

The thickness of the photosensitive layer is usually from 5 to 50 μm, preferably from 10 to 45 μm from the viewpoint of the prolongation of life and image stability, more preferably from 10 to 30 μm with a view to achieving high definition.

(Compound of the Formula (1))

The electrophotographic photoreceptor of the present invention comprises an electroconductive substrate and a photosensitive layer formed thereon, wherein the photosensitive layer contains a compound represented by the following formula (1). In a case where the photosensitive layer is formed by a plurality of layers, the compound represented by the formula (1) of the present invention may be contained by any of these layers, and different layers may respectively contain different compounds. However, since the compound represented by the formula (1) usually has charge transport properties, such a compound is usually contained in a layer for which a charge transport function is required:

(1)

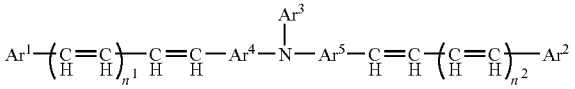

wherein each of $Ar^1$, $Ar^2$ and $Ar^3$ is an aryl group which may have a substituent, each of $Ar^4$ and $Ar^5$ which are independent of each other, is an arylene group which may have a substituent, and each of $n^1$ and $n^2$ which are independent of each other, is an integer of from 1 to 3. The ratio of the weight of the compound represented by the formula (1) to the weight content of all binder resins contained in the photosensitive layer is from 0.15 to 0.9.

In the formula (1), the aryl group for each of $Ar^1$ to $Ar^3$ is not particularly limited so long as it is a ring having aromaticity, and it may, for example, be a phenyl group, an indenyl group, a naphthyl group, an acenaphthyl group, a phenanthryl group or a pyrenyl group. Among them, preferred is a phenyl group or a naphthyl group from the viewpoint of extension of the intramolecular conjugation and reduction in the permanent dipole moment of molecules.

The substituent which the aryl group for each of $Ar^1$ to $Ar^3$ may have is not particularly limited and it may, for example, be an alkyl group such as a methyl group, an ethyl group, a propyl group, an isopropyl group or an allyl group; an alkoxy group such as a methoxy group, an ethoxy group or a propoxy group; an aryl group such as a phenyl group, an indenyl group, a naphthyl group, an acenaphthyl group, a phenanthryl group or a pyrenyl group; or a heterocyclic group such as an indolyl group, a quinolyl group or a carbazolyl group. Further, such substituents may be bonded by a connecting group or directly to form a ring.

Further, such a substituent has an effect of increasing the charge mobility by improving the charge balance in molecules when one having a large number of carbon atoms is employed, whereas if the number of carbon atoms is too large, the charge mobility is rather decreased by distortion of the conjugate plane in molecules and the intermolecular steric repulsion. Accordingly, the number of carbon atoms is preferably at least 2, more preferably at least 3, and preferably at most 10, more preferably at most 6, particularly preferably at most 4.

Further, when the aryl group has a substituent, the number is preferably large and it preferably has a plurality of substituents. However, if it has too many substituents, the charge mobility is rather decreased by distortion of the conjugate plane in molecules and the intermolecular steric repulsion. Accordingly, the number of substituents is preferably at most 4, more preferably at most 3. Further, the substituent is preferably sterically bulky one, and preferably a substituent having a branched structure rather than a linear structure, so as to improve stability in the photosensitive layer and to prevent clouding of the photosensitive layer. More specifically, a methyl group, an ethyl group, a butyl group, an isopropyl group or a methoxy group is preferred.

Further, it is preferred that $Ar^1$ and $Ar^2$ have no substituent and $Ar^3$ has a substituent, and it is more preferred that $Ar^3$ has a plurality of substituents. The substituent which $Ar^3$ has is preferably an alkyl group so as to improve stability of the compound represented by the formula (1) in the photosensitive layer, more preferably a branched alkyl group, an alkyl group having at least two carbon atoms, and/or a plurality of alkyl groups. Further, in the case of a branched alkyl, the number of carbon atoms is preferably at least 3 and at most 7. More preferably, the number of carbon atoms is at most 4, and isopropyl is preferred.

Each of $Ar^4$ and $Ar^5$ which are independent of each other, is an arylene group which may have a substituent, and the arylene group is not particularly limited so long as it is a ring having aromaticity. It may, for example, be a phenylene group, an indenylene group, a naphthylene group, an acenaphthylene group, a phenanthrylene group or a pyrenylene group. Further, the binding position is not limited, but with a view to reducing the molecular size as far as possible and reducing the intermolecular steric repulsion, preferred is a p-phenylene, m-phenylene, 1,3-naphthylene or 1,4-naphthylene group, and particularly preferred is a p-phenylene group.

The substituent which each of $Ar^4$ and $Ar^5$ may have is not particularly limited, and it may, for example, be an alkyl group such as a methyl group, an ethyl group, a propyl group, an isopropyl group or an allyl group; an alkoxy group such as a methoxy group, an ethoxy group or a propoxy group; an aryl group such as a phenyl group, an indenyl group, a naphthyl group, an acenaphthyl group, a phenanthryl group or a pyrenyl group; or a heterocyclic group such as an indolyl group, a quinolyl group or a carbazolyl group. Further, such substituents may be bonded by a connecting group or directly to form a ring. Although such a substituent has an effect of increasing the charge mobility by an electron donative effect, if the substituent size is too large, the charge mobility is rather decreased by distortion of the conjugate plane in molecules and the intermolecular steric repulsion. Accordingly, the number of carbon atoms is preferably at most 10, more preferably at most 6, and particularly preferred is a methyl group or a methoxy group. With respect to the number of substituents also, an effect of increasing the charge mobility is obtained when it is large, but if it is too large, the charge mobility is decreased by distortion of the conjugate plane in molecules and the intermolecular steric repulsion. Accordingly, it is preferably at most 3, more preferably at most 2.

In the formula (1), each of $n^1$ and $n^2$ which are independent of each other, is an integer of from 1 to 3, and in view of stability in production, stability of electric characteristics, etc., at least one of $n^1$ and $n^2$ is preferably 1. Further, with a view to increasing the mobility, at least one of $n^1$ and $n^2$ is preferably at least 2.

Further, the compound represented by the formula (1) has stereoisomers at portions having a double bond. However, in the present invention, regarding the stereoisomers at the portion, a mixture of isomers and a compound consisting of a single stereostructure are considered as one type of a compound to calculate the weight ratio to binder resins and the weight ratio to another charge transport material.

The compound represented by the formula (1) has four double bonds or groups of double bonds (a) to (d) as shown in the following formula (2). However, in a case where $n^1$ and $n^2$ are both 1 or in a case where $n^1$ is different from $n^2$, the ratio of either isomer component is preferably at least 80 mol %, more preferably at least 90 mol % based on all the stereoisomers. Further, in a case where $n^1$ and $n^2$ are the same and both are from 2 to 3, the ratio of either isomer component is preferably at least 30 mol % and at most 80 mol %, more preferably at least 40 mol % and at most 70 mol %, based on all the stereoisomers. Considering the electric characteristics, it is preferred that the amount of a trans-form is large:

(2)

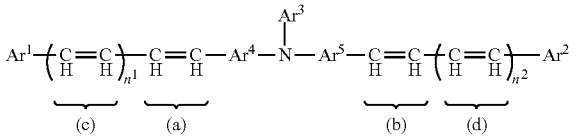

Regardless of the numbers of $n^1$ and $n^2$, and the presence or absence and the type of the substituent of $Ar^3$, each of the sum of trans-isomer components regarding (a) and the sum of trans-isomer components regarding (b) is preferably at least 40 mol %, particularly preferably at least 50 mol %. Further, from the viewpoint of the stability of the compound represented by the formula (1) in the photosensitive layer, each is preferably at most 98 mol %, more preferably at most 90 mol %, particularly preferably at most 80 mol %. In such a case, it is preferred to use a charge transport material different from the compound represented by the formula (1) in combination.

More specifically, in a case where $n^1$ and $n^2$ are both 1 and $Ar^3$ has a substituent, each of the sum of trans-isomer components regarding (c) and the sum of trans-isomer components regarding (d) is preferably at least 90 mol %, particularly preferably at least 95 mol %. Further, each of the sum of trans-isomer components regarding (a) and the sum of trans-isomer components regarding (b) is preferably at least 70 mol %, particularly preferably at least 80 mol %.

In a case where the substituent which $Ar^3$ has is an alkyl group, each of the sum of trans-isomer components regarding (a) and the sum of trans-isomer components regarding (b) is preferably at least 85 mol %, particularly preferably at least 90 mol %. In a case of a branched alkyl group, each of the sum of trans-isomer components regarding (a) and the sum of trans-isomer components regarding (b) is preferably at least 90 mol %, particularly preferably at least 95 mol %.

In a case where $Ar^3$ has no substituent, each of the sum of trans-isomer components regarding (c) and the sum of trans-isomer components regarding (d) is preferably at least 85 mol %, particularly preferably at least 90 mol %. Specific examples of the compound represented by the formula (1) of the present invention are shown below.

The compound represented by the formula (1) has charge transport properties and can be used as the charge transport material of the electrophotographic photoreceptor. Exemplified compounds 1 to 20 are shown below.

1

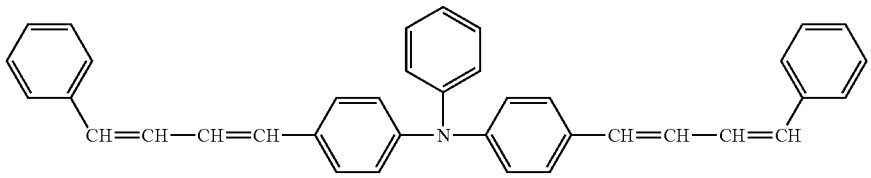

2

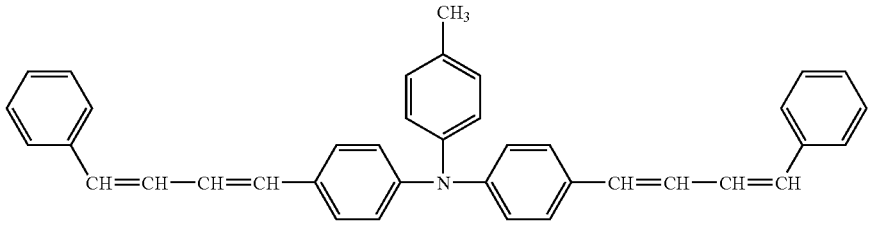

3

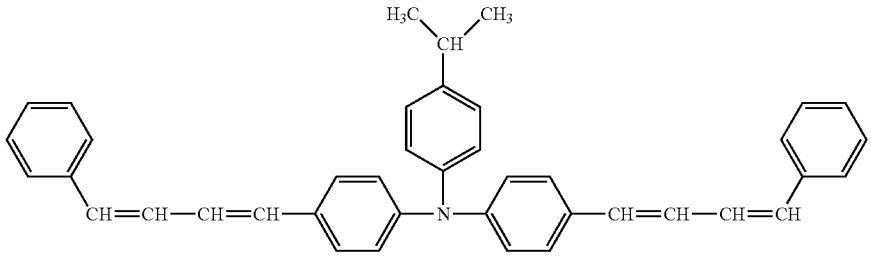

4

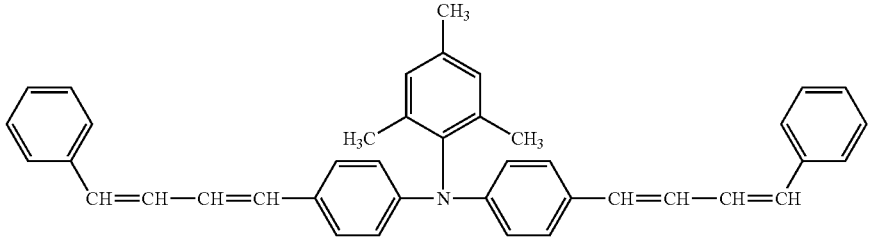

-continued
5
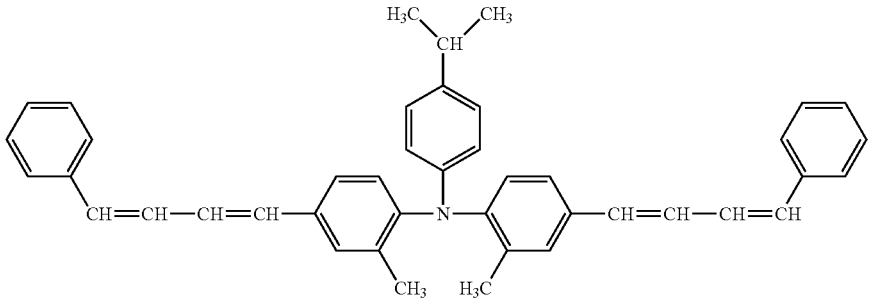
6
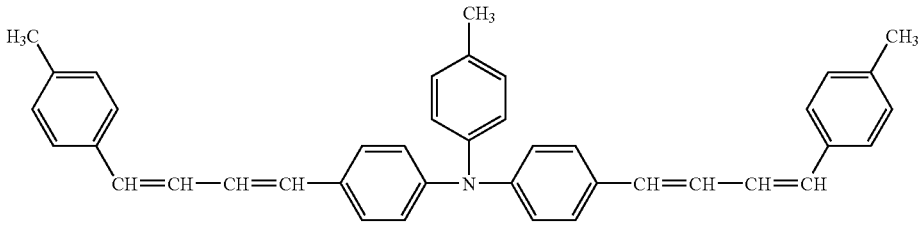
7
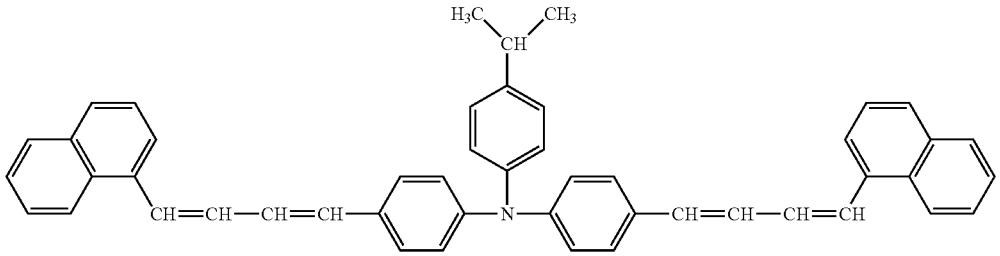
8
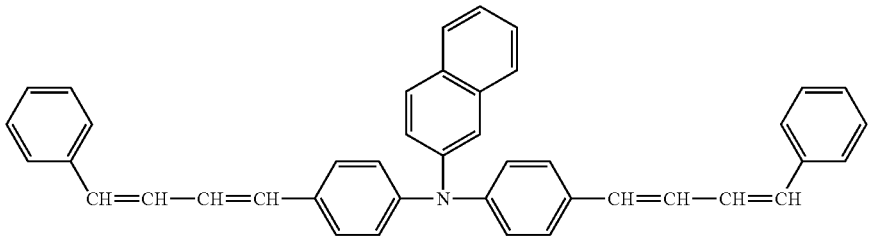
9
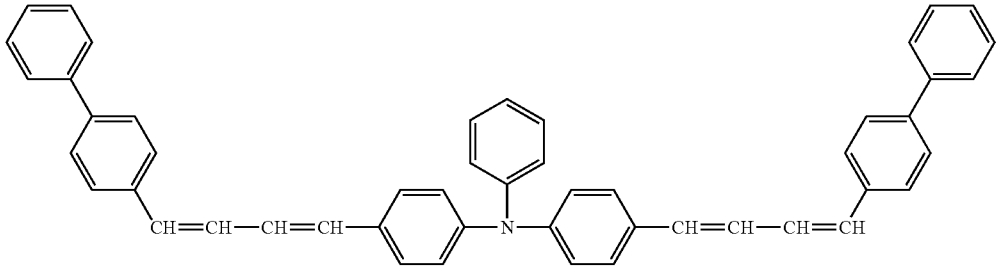
10
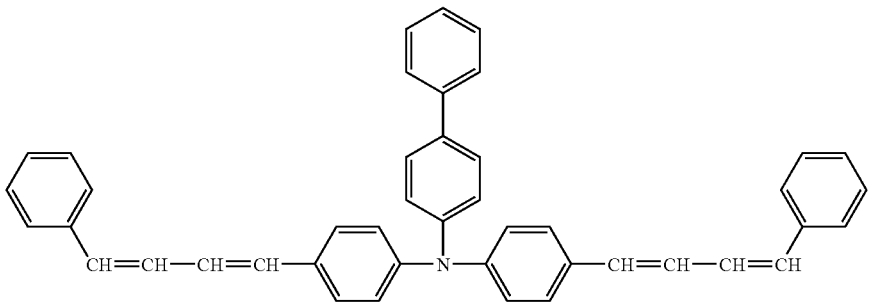

-continued
11
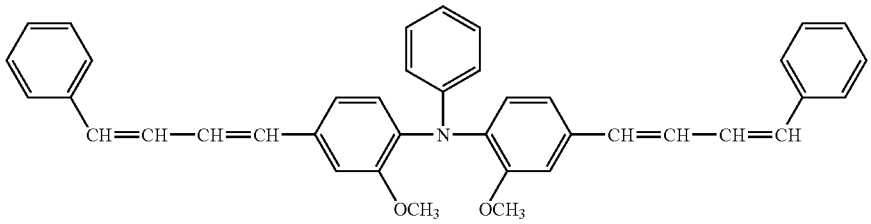
12
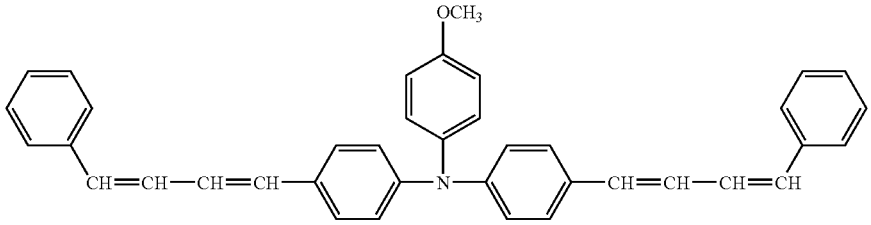
13
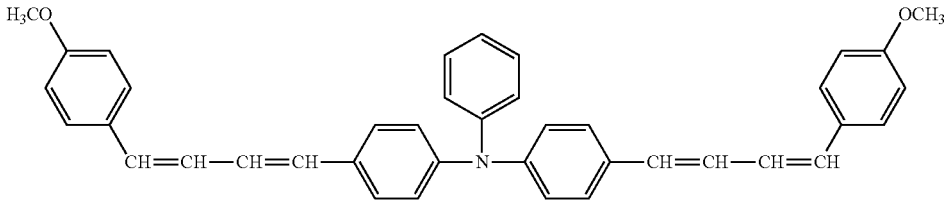
14
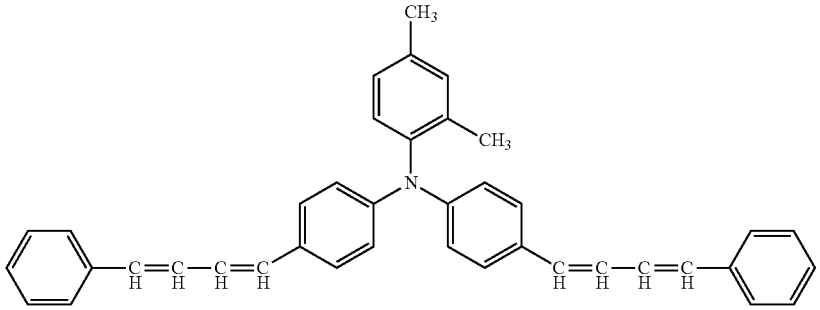
15
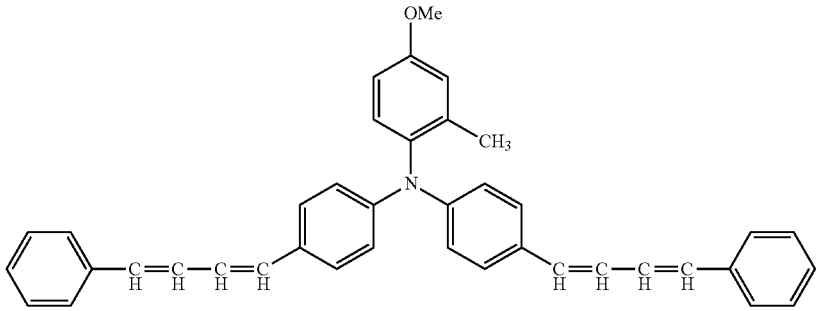
16
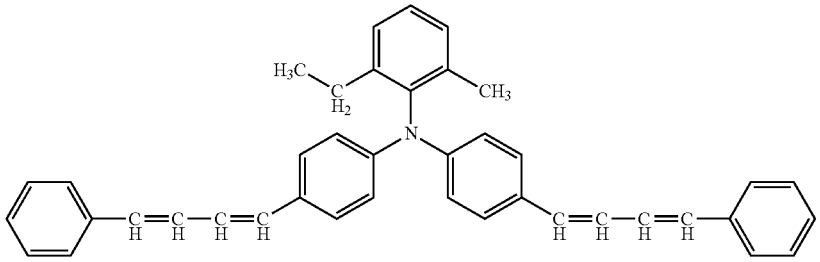

-continued

17

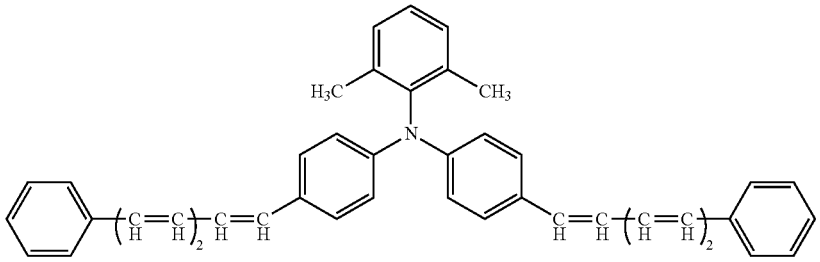

18

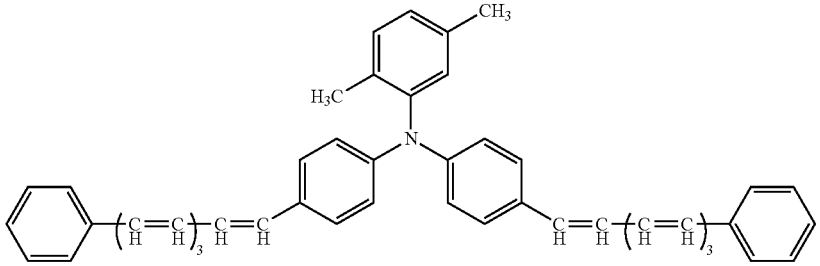

19

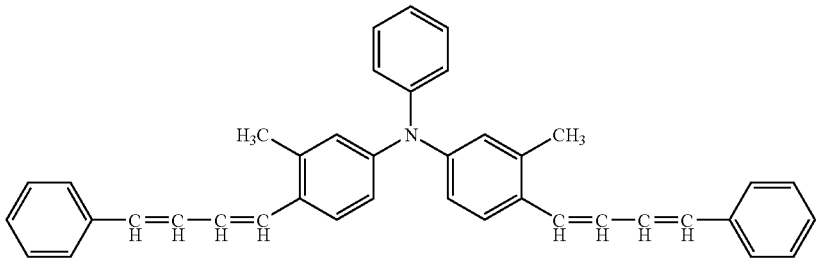

20

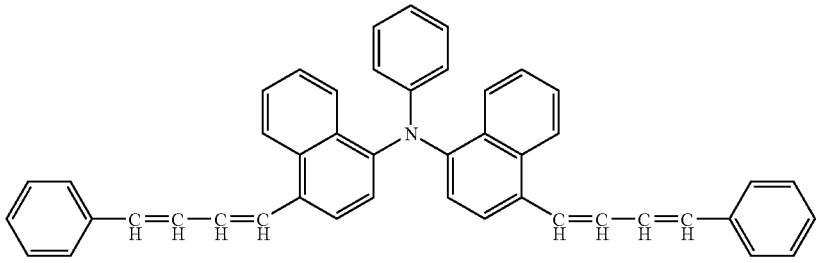

The photosensitive layer which the electrophotographic photoreceptor of the present invention has is usually bound by a binder resin. In such a case, the photosensitive layer can be obtained by applying and drying a coating liquid obtained by dissolving or dispersing the compound of the formula (1) and a binder resin in a solvent. The binder resin may, for example, be a polymer or copolymer of a vinyl compound such as butadiene, styrene, vinyl acetate, vinyl chloride, an acrylic ester, a methacrylic ester, vinyl alcohol or ethyl vinyl ether, polyvinyl butyral, polyvinyl formal, partially modified polyvinyl acetal, polycarbonate, polyester, polyarylate, polyamide, polyurethane, cellulose ether, a phenoxy resin, a silicon resin, an epoxy resin or a poly-N-vinylcarbazol resin. Among them, polycarbonate or polyarylate is preferred, and polycarbonate or polyarylate having the following structural units is particularly preferred. Among them, polycarbonate having the following structural units on the right side is more preferred. Further, it is more preferred that polycarbonate having the following structural units on the left side is contained and the ratio of the weight of the compound represented by the above formula (1) to the weight content of all binder resins in the photosensitive layer is from 0.15 to 0.9:

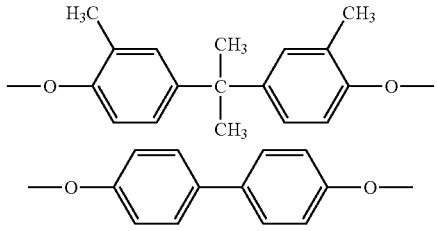

Such binder resins may be used as a mixture of two or more. Further, the binder resin may be crosslinked by heat, light or the like using a proper curing agent or the like.

In the photosensitive layer which the electrophotographic photoreceptor of the present invention has, as the weight ratio of the compound represented by the formula (1) to the binder resin, the ratio of the weight of the compound represented by the formula (1) to the weight content of all binder resins contained in the photosensitive layer, i.e. the value obtained by dividing the value of the weight of the compound represented by the formula (1) by the weight content of all binder resins in the photosensitive layer, is preferably from 0.15 to 0.9. It is more preferably at least 0.20 with a view to lowering the residual potential of the electrophotographic photoreceptor, and it is furthermore preferably at least 0.25 from the viewpoint of stability when repeatedly used and the charge mobility. On the other hand, it is usually at most 0.9 from the viewpoint of thermal stability of the photosensitive layer, and it is preferably at most 0.8 from the viewpoint of stability of the compound of the formula (1) in the photosensitive layer, more preferably at most 0.65, furthermore preferably at most 0.6 from the viewpoint of durability at the time of image formation, and particularly preferably at most 0.4 from the viewpoint of scar resistance.

It is also preferred that the photosensitive layer which the electrophotographic photoreceptor of the present invention has contains a polyarylate. The polyarylate functions as a binding resin. The polyarylate is one type of polyesters, and is formed by condensation of a bivalent alcohol having a ring with aromaticity and a bivalent carboxylic acid having a ring with aromaticity.

In a case where the photosensitive layer which the electrophotographic photoreceptor of the present invention has contains a polyarylate, the weight ratio of the compound represented by the formula (1) to the binder resin is not limited. Usually, the ratio of the weight of the compound represented by the formula (1) to the weight content of all binder resins contained in the photosensitive layer, i.e. the value obtained by dividing the value of the weight of the compound represented by the formula (1) by the weight content of all binder resins in the photosensitive layer is preferably from 0.15 to 0.9. With a view to lowering the residual potential of the electrophotographic photoreceptor, it is preferably at least 0.20, and from the viewpoint of stability when repeatedly used and the charge mobility, it is more preferably at least 0.25. On the other hand, it is usually at most 0.9 from the viewpoint of thermal stability of the photosensitive layer, and it is preferably at most 0.8 from the viewpoint of stability of the compound of the formula (1) in the photosensitive layer, more preferably at most 0.65, furthermore preferably at most 0.6 from the viewpoint of durability at the time of image formation, and particularly preferably at most 0.4 from the viewpoint of scar resistance.

The viscosity average molecular weight of the polyarylate is not particularly limited, and it is usually at least 10,000, preferably at least 15,000, more preferably at least 20,000, and it is at most 300,000, is preferably at most 200,000, more preferably at most 100,000. If the viscosity average molecular weight is excessively low, mechanical strength of the photosensitive layer tends to decrease, such being impractical. Further, if the viscosity average molecular weight is excessively high, it will be difficult to form the photosensitive layer in a proper thickness by coating.

The bivalent alcohol having a ring with aromaticity may be any one usually used for production of a polyarylate, and preferably a bisphenol and/or a biphenol is used. Each of the bisphenol and the biphenol may independently have a substituent on their aromatic rings, and the substituent is more specifically an alkyl group, an aryl group, a halogen atom or an alkoxy group. Considering mechanical characteristics as the binder resin for a photosensitive layer and the solubility in a solvent in preparation of a coating liquid for formation of photosensitive layer, the alkyl group is preferably an alkyl group having at most 6 carbon atoms, more preferably a methyl group, an ethyl group or a propyl group. The aryl group is preferably an aryl group having at most 3 aromatic rings, more preferably a phenyl group or a naphthyl group. The halogen atom is preferably a fluorine atom, a chlorine atom, a bromine atom, an iodine atom or the like. The alkoxy group is preferably an alkoxy group in which the alkyl group moiety has from 1 is to 10 carbon atoms, more preferably from 1 to 8 carbon atoms, particularly preferably from 1 to 2 carbon atoms. Among them, a methoxy group, an ethoxy group, a butoxy group or the like is preferred.

Specifically, preferred is bis(4-hydroxyphenyl)methane, (2-hydroxyphenyl)(4-hydroxyphenyl)methane, bis(2-hydroxyphenyl)methane, bis(4-hydroxy-3-methylphenyl)methane, bis(4-hydroxy-3-ethylphenyl)methane, bis(4-hydroxy-3,5-dimethylphenyl)methane; 1,1-bis(4-hydroxyphenyl)ethane, 1-(2-hydroxyphenyl)-1-(4-hydroxyphenyl)ethane, 1,1-bis(2-hydroxyphenyl)ethane, 1,1-bis(4-hydroxy-3-methylphenyl)ethane, 1,1-bis(4-hydroxy-3-ethylphenyl)ethane, 1,1-bis(4-hydroxy-3,5-dimethylphenyl)ethane, 1,1-bis(4-hydroxy-3-methylphenyl)ethane, 1,1-bis(4-hydroxy-3,5-dimethylphenyl)ethane; 3,3',5,5'-tetramethyl-4,4'-dihydroxybiphenyl, 2,2-bis(4-hydroxy-3,5-dimethylphenyl)propane, 2,2-bis(4-hydroxy-3-methylphenyl)propane, 2,2-bis(4-hydroxyphenyl)propane, 2,2-bis(4-hydroxy-3,5-dimethylphenyl)propane; 1,1-bis(4-hydroxy-3,5-dimethylphenyl)cyclohexane, 1,1-bis(4-hydroxy-3-methylphenyl)cyclohexane, 1,1-bis(4-hydroxyphenyl)cyclohexane; bis(4-hydroxyphenyl)ketone; bis(4-hydroxyphenyl)ether, bis(4-hydroxy-3,5-dimethylphenyl)ether, (2-hydroxyphenyl)(4-hydroxyphenyl)ether, bis(2-hydroxyphenyl)ether, bis(4-hydroxy-3-methylphenyl)ether or bis(4-hydroxy-3-ethylphenyl)ether. Such bivalent phenol components may be used in combination.

Among them, particularly preferred is a polyarylate having a bivalent alcohol of the following structure as a repeating unit structure.

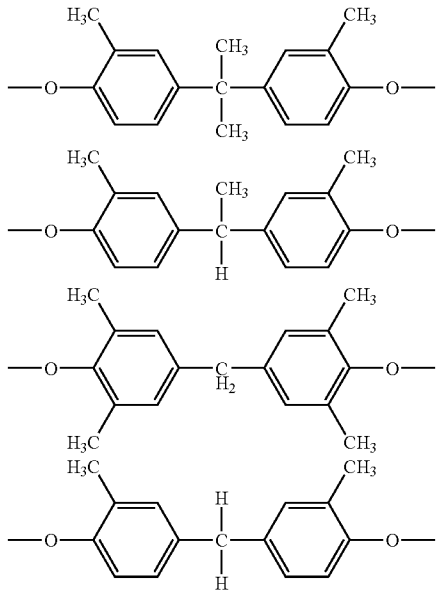

The bivalent carboxylic acid having a ring with aromaticity may be any one usually used for production of a polyarylate. More specifically, it may be phthalic acid, isophthalic acid, naphthalene-1,4-dicarboxylic acid, naphthalene-2,6-dicarboxylic acid, biphenyl-2,2'-dicarboxylic acid, biphenyl-4,4'- dicarboxylic acid, diphenyl ether-2,2'-dicarboxylic acid, diphenyl ether-2,3'-dicarboxylic acid, diphenyl ether-2,4'-dicarboxylic acid, diphenyl ether-3,3'-dicarboxylic acid, diphenyl ether-3,4'-dicarboxylic acid or diphenyl ether-4,4'-dicarboxylic acid. It is preferably isophthalic acid, terephthalic acid, diphenyl ether-2,2'-dicarboxylic acid, diphenyl ether-2,4'-dicarboxylic acid or diphenyl ether-4,4'-dicarboxylic acid, particularly preferably isophthalic acid, terephthalic acid, diphenyl ether-4,4'-dicarboxylic acid or biphenyl-4,4'-dicarboxylic acid. Such dicarboxylic acids may be used in combination.

A method for producing the polyarylate of the present invention is not particularly limited, and a known polymerization method such as an interfacial polymerization method, a molten polymerization method or a solution polymerization method may be employed.

For example, in the case of production by an interfacial polymerization method, a solution having a bivalent phenol component dissolved in an aqueous alkaline solution and a solution of a halogenated hydrocarbon having an aromatic dicarboxylic chloride component dissolved therein, are mixed. At that time, as a catalyst, a quaternary ammonium salt or a quaternary phosphonium salt may be present. The polymerization temperature is preferably within a range of from 0 to 40° C., and the polymerization time is preferably within a range of from 2 to 20 hours, in view of productivity. After completion of the polymerization, an aqueous phase and an organic phase are separated, and a polymer dissolved in the organic phase is washed and recovered by a known method to obtain an aimed polyarylate.

The alkali component used in the interfacial polymerization method may, for example, be a hydroxide of an alkali metal such as sodium hydroxide or potassium hydroxide. The amount of the alkali is preferably within a range of from 1.01 to 3 equivalent amount of the phenolic hydroxyl groups contained in the reaction system. The halogenated hydrocarbon may, for example, be dichloromethane, chloroform, 1,2-dichloroethane, trichloroethane, tetrachloroethane or dichlorobenzene. The quaternary ammonium salt or the quaternary phosphonium salt used as the catalyst may, for example, be a salt such as hydrochloride, bromate or iodate of a tertiary alkyl amine such as tributylamine or trioctylamine; or benzyltriethylammonium chloride, benzyltrimethylammonium chloride, benzyltributylammonium chloride, tetraethylammonium chloride, tetrabutylammonium chloride, tetrabutylammonium bromide, trioctylmethylammonium chloride, tetrabutyl phosphonium bromide, triethyloctadecyl phosphonium bromide, N-laurylpyridinium chloride or laurylpicolinium chloride.

Further, in the interfacial polymerization method, a molecular weight modifier may be used. The molecular weight modifier may, for example, be an alkyl phenol such as phenol, o,m,p-cresol, o,m,p-ethylphenol, o,m,p-propylphenol, o,m,p-(tert-butyl)phenol, pentylphenol, hexylphenol, octylphenol, nonylphenol, a 2,6-dimethylphenol derivative or a 2-methylphenol derivative; a monofunctional phenol such as o,m,p-phenylphenol; or a monofunctional acid halide such as acetyl chloride, butyryl chloride, octyl chloride, benzoyl chloride, benzenesulfonyl chloride, benzenesulfinyl chloride, sulfinyl chloride or benzene phosphonyl chloride, or a substituted product thereof. Among such molecular weight modifiers, preferred is o, m, p-(tert-butyl)phenol, a 2,6-dimethylphenol derivative or a 2-methylphenol derivative in view of high molecular weight modifying property and stability of the solution. Particularly preferred is p-(tert-butyl)phenol, 2,3,6-tetramethylphenol or 2,3,5-tetramethylphenol.

When a polyarylate is used as the binder, the photosensitive layer of the present invention can be obtained by applying and drying a coating liquid obtained by dissolving or dispersing the compound of the above formula (1), the polyarylate, and as the case requires, another binder resin in a solvent. The binder resin may, for example, be a polymer or copolymer of a vinyl compound such as butadiene, styrene, vinyl acetate, vinyl chloride, an acrylic ester, a methacrylic ester, vinyl alcohol or ethyl vinyl ether, polyvinyl butyral, polyvinyl formal, partially modified polyvinyl acetal, polycarbonate, polyester, polyarylate, polyamide, polyurethane, cellulose ether, a phenoxy resin, a silicon resin, an epoxy resin or a poly-N-vinylcarbazol resin.

Further, a copolymer or a blended mixture of a polyarylate with a polycarbonate is also preferred. Further, such a resin may be crosslinked by heat, light or the like by using a proper curing agent or the like. Such binders may be used as a blended mixture of two or more.

In a case where $Ar^3$ of the compound represented by the formula (1) has a substituent, as the weight ratio of the compound represented by the formula (1) to the binder resin, the ratio of the weight of the compound represented by the formula (1) to the weight content of all binder resins contained in the photosensitive layer i.e. the value obtained by dividing the value of the weight of the compound represented by the formula (1) by the weight content of all binder resins in the photosensitive layer is preferably from 0.20 to 0.7, more preferably at most 0.5, particularly preferably at most 0.4.

For the purpose of favorable image formation, it is also preferred to use a plural types of compounds represented by the formula (1). Further, for the same purpose, it is preferred that the photosensitive layer contains the compound represented by the formula (1) and in addition, a known charge transport material (in combination). In such a case, the sum of the compound represented by the formula (1) and the total amount of the charge transport material contained in the photosensitive layer is preferably at least 25 parts by weight per 100 parts by weight of the binder resin, preferably at least 35 parts by weight with a view to reducing the residual potential, and more preferably at least 40 parts by weight from the viewpoint of stability when repeatedly used and the charge mobility. On the other hand, it is usually at most 100 parts by weight from the viewpoint of thermal stability of the photosensitive layer, preferably at most 75 parts by weight from the viewpoint of the miscibility of the charge transport material with the binder resin, more preferably at most 60 parts by weight from the viewpoint of printing resistance, and most preferably at most 50 parts by weight from the viewpoint of scar resistance.

The charge transport material which can be used (in combination) may be any material so long as it has charge transport properties. In such a case, it is preferred that the weight content of the compound represented by the formula (1) is maximum among all charge transport materials or the compound represented by the formula (1) is contained in an amount of at least 90% by the weight ratio as compared with the maximum content component among charge transport materials contained in the photoreceptor. In calculation of the weight content, geometric isomers are considered as an identical compound.

As preferred examples of the charge transport material which can be used in combination, the following compounds may be mentioned. However, it is not limited to such exemplified compounds without departing from the spirit and scope of the present invention:

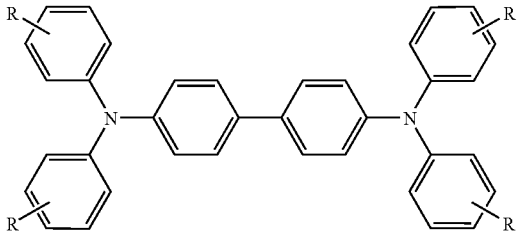
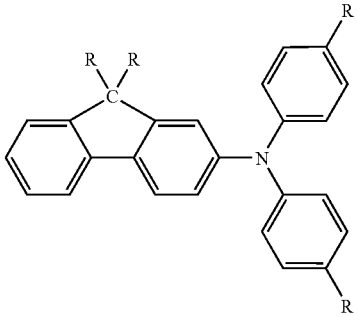
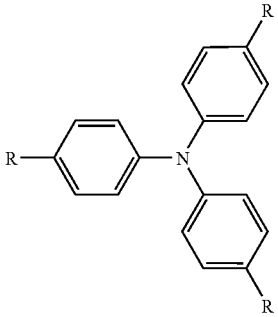
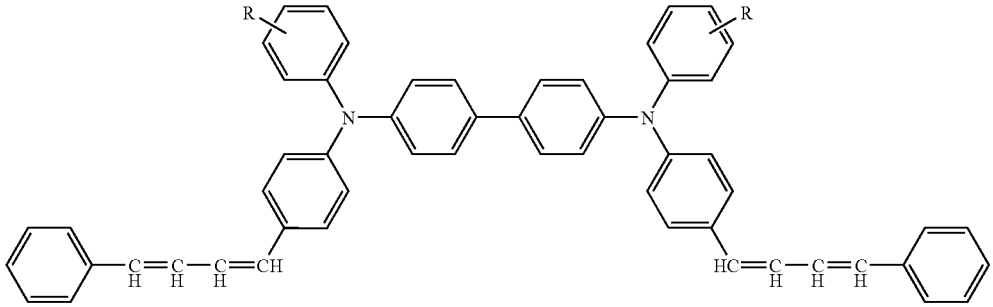
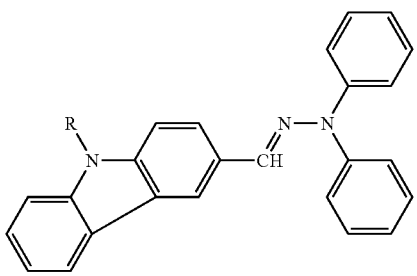
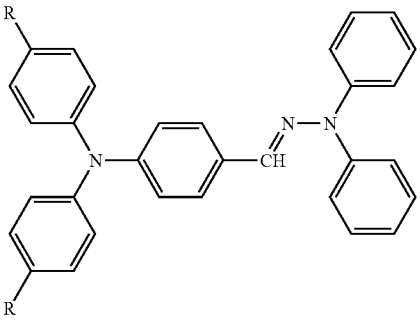
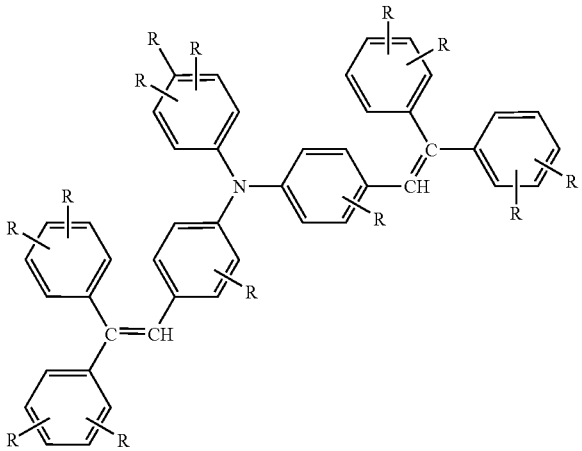
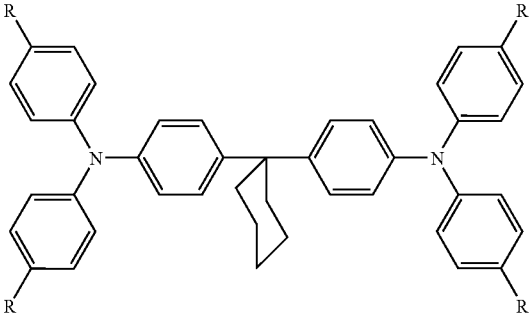
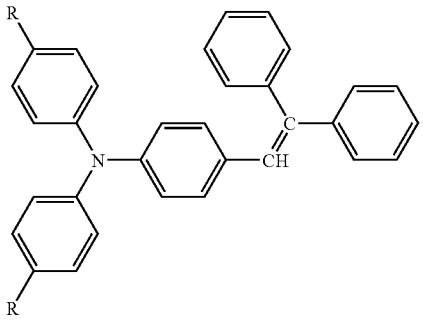

In the formulae, each of R's which may be different in one formula, is a hydrogen atom or a substituent. The substituent is preferably an alkyl group, an alkoxy group, a phenyl group or the like, particularly preferably a methyl group. Among them, particularly a compound having a benzidine structure or a compound having a butadiene structure, which exhibits excellent performance when used in combination with the compound represented by the formula (1), is very effective.

(Electroconductive Substrate)

As the electroconductive substrate of the electrophotographic photoreceptor of the present invention, a metallic materials such as aluminum, an aluminum alloy, stainless steel, copper or nickel; a resin material having a conductive powder such as a metal, carbon or tin oxide added to impart electroconductivity; a resin, glass or paper with an electroconductive material such as aluminum, nickel or is ITO (indium tin oxide) deposited or coated on its surface, may, for example, be mainly used. It is used in a drum form, sheet form, belt form, or the like. An electroconductive substrate made of a metallic material coated with an electroconductive material having an appropriate resistance value for controlling e.g. the conductivity and the surface properties, or covering the defects, may also be used.

The substrate surface may be either smooth, or roughened by using a particular cutting method or carrying out a polishing treatment. Further, it may also be one roughened by mixing particles with an appropriate particle size in the material constituting the substrate. Further, to lower the cost, a drawn tube without cutting treatment may be used as it is.

In a case where a metallic material such as an aluminum alloy is used as the electroconductive substrate, it is preferably used after having undergone an anodic oxidation treatment. When it is subjected to the anodic oxidation treatment, it is preferably subjected to a sealing treatment by a known method, whereby the image characteristics can be improved and the electric characteristics can be stabilized when image formation is carried out by using the electrophotographic photoreceptor of the present invention.

The anodic oxidation treatment may be carried out by an optional method, and it is usually carried out by applying electricity in an acidic bath using the electroconductive substrate as an electrode. The acidic bath is not particularly limited, and an acidic bath of e.g. chromic acid, sulfuric acid, oxalic acid, boric acid or sulfamic acid may be mentioned. Among them, anodic oxidation in sulfuric acid will bring best results.

For example, the treatment conditions in the case of carrying out an anodic oxidation treatment of an electroconductive substrate made of aluminum in sulfuric acid are preferably such that the sulfuric acid concentration is from 100 g/L to 300 g/L, the dissolved aluminum concentration is from 2 g/L to 15 g/L, the liquid temperature is from 15° C. to 30° C., the electrolysis voltage is from 10 V to 20 V, and the current density is from 0.5 A/dm$^2$ to 2 A/dm$^2$. However, the anodic oxidation treatment conditions are not limited thereto.

By conducting such anodic oxidation treatment, an anodic oxide film is formed on the surface of the electroconductive substrate.

The electroconductive substrate of the present invention is subjected to a sealing treatment after the anodic oxide film is formed on the surface by the anodic oxidation treatment. The sealing treatment may be carried out by an optional method, and it is usually carried out by immersing the electrocondcutive substrate in a sealing agent aqueous solution (sealing liquid) containing a sealing agent. As typical examples, a low temperature sealing treatment of immersing the electroconductive substrate in a sealing agent aqueous solution at low temperature and a high temperature sealing treatment of immersing the electroconductive substrate in a sealing agent aqueous solution at high temperature may be mentioned.

(Low Temperature Sealing Treatment)

The low temperature sealing treatment is carried out, as described above, by immersing the electroconductive substrate in a sealing agent aqueous solution at low temperature.

In the low temperature sealing treatment, as the sealing agent, usually nickel fluoride is used as the main component.

The concentration of the sealing agent in the sealing agent aqueous solution used for the low temperature sealing treatment is optional, and usually it is most effective to carry out the treatment at a concentration of from 3 g/L to 6 g/L.

Further, in order that the sealing treatment proceeds smoothly, the treatment temperature is usually at least 25° C., preferably at least 30° C., and usually at most 40° C., preferably at most 35° C.

Further, the pH of the sealing agent aqueous solution is usually at least 4.5, preferably at least 5.5, and usually at most 6.5, preferably at most 6.0. As a pH adjustor to be used for adjusting the pH is not is limited and is optional, and oxalic acid, boric acid, formic acid, acetic acid, sodium hydroxide, sodium acetate or ammonia water may, for example, be used.

Further, the treatment time is optional, and it is preferred to carry out the treatment usually for from 1 minute to 3 minutes per 1 μm of the thickness of the coating film.

Here, the sealing agent aqueous solution may contain a material other than the sealing agent. For example, a metal salt such as cobalt fluoride, cobalt acetate or nickel sulfate, a surfactant or the like may preliminarily be mixed with an additive aqueous solution so as to further improve physical properties of the coating film.

After immersion, washing with water and drying are carried out to complete the low temperature sealing treatment.

(High Temperature Sealing Treatment)

On the other hand, the high temperature sealing treatment is carried out by immersing the electroconductive substrate in a sealing agent aqueous solution at high temperature.

For the low temperature sealing treatment, as the sealing agent, a metal salt such as nickel acetate, cobalt acetate, lead acetate, nickel-cobalt acetate or barium nitrate may be used, and usually nickel acetate is used as the main component.

The concentration of the sealing agent in the sealing agent aqueous solution used for the high temperature sealing treatment is optional, and it is most effective to carry out the treatment usually at a concentration of from 5 g/L to 20 g/L.

Further, in order that the sealing treatment proceeds smoothly, the treatment temperature is usually at least 80° C., preferably at least 85° C., and usually at most 100° C., preferably at most 98° C.

Further, the pH of the sealing agent aqueous solution is usually at least 4.5, preferably at least 5.0, and usually at most 6.5, preferably at most 6.0. A pH adjustor to be used for adjusting the pH is not limited and optional, and for example, the same adjustor as in the low temperature sealing treatment may be used.

Further, the treatment time is optional, and it is preferred to carry out the treatment usually for at least one second, preferably for at least 2 second per 1 μm of the thickness of the coating film.

Here, in the same manner as in the low temperature sealing treatment, in the high temperature sealing treatment also, the sealing agent aqueous solution may contain a material other than the sealing agent. For example, sodium acetate, an organic carboxylate or the like, an anionic or nonionic surfactant, or the like may be preliminarily mixed with an additive aqueous solution so as to further improve physical properties of the coating film.

After immersion, washing with water and drying are carried out to complete the high temperature sealing treatment.

In a case where the anodic oxide film has a thick average film thickness, stronger sealing conditions such as a high concentration of the sealing liquid and treatment at a higher temperature for a longer time are required. Thus, not only the productivity tends to be poor, but also surface defects such as stain, dirt or dust attachment are likely to occur. From such a viewpoint, the average thickness of the anodic oxide film is usually preferably at most 20 μm, preferably at most 7 μm.

(Roughing)

Further, the surface of the electroconductive substrate may be smooth or may be preliminarily roughed before the anodic oxidation treatment. The roughing method is optional, and for example, roughing can be conducted by using a particular cutting method or carrying out a polishing treatment. Further, roughing is also possible by mixing particles with an appropriate particle size in the material constituting the electroconductive substrate. Further, to lower the cost, a drawn tube without cutting treatment may be used as it is as the electroconductive substrate. Particularly in a case where a non-cut aluminum substrate obtained by drawing, impact extrusion, ironing or the like is used, attachments such as stain or foreign matters, small scratches, etc. on the surface are eliminated by the treatment, whereby a uniform and clean electroconductive substrate will be obtained, such being favorable.

(Undercoat Layer)

An undercoat layer may be provided between the electroconductive substrate and the photosensitive layer for improving the adhesion, the blocking tendency, etc. The undercoat layer is a layer which is provided between the electroconductive substrate and the photosensitive layer, which has at least one function to improve adhesion between the electroconductive substrate and the photosensitive layer, to mask stain, scratches, etc. on the electroconductive substrate, to prevent carrier injection by heterogeneous surface properties or impurities, to reduce nonuniformity of electric characteristics, to prevent a decrease of the surface potential by repeated use, to prevent local fluctuations in surface potential which may cause image defects, etc., and which is a layer not essential for development of photoelectric characteristics.

As the undercoat layer, a resin, one obtained by dispersing particles of a metal oxide or the like in a resin, or the like is used. Examples of the metal oxide particles to be used for the undercoat layer include particles of a metal oxide containing one metallic element such as titanium oxide, aluminum oxide, silicon oxide, zirconium oxide, zinc oxide or iron oxide; and particles of a metal oxide containing a plurality of metallic elements such as calcium titanate, strontium titanate and barium titanate. These particles may be used singly or as a mixture of a plurality thereof. Among such metallic oxide particles, titanium oxide or aluminum oxide is preferred, and titanium oxide is particularly preferred. The titanium oxide particles may be surface-treated by an inorganic substance such as tin oxide, aluminum oxide, antimony oxide, zirconium oxide or silicon oxide, or an organic substance such as stearic acid, polyol or silicone. Any crystalline form of the titanium oxide particles such as rutile-, anatase-, brookite-, or amorphous-form may be used. A plurality of crystalline forms may also be included therein.

Further, although the particle size of the metal oxide particles usable may be various ones, among them, the average primary particle size is preferably at least 10 nm and at most 100 nm, particularly preferably at least 10 nm and at most 50 nm in view of the characteristics and the solution stability.

The undercoat layer is preferably formed into such a structure that the metal oxide particles are dispersed in the binder resin. Examples of the binder resin to be used for the undercoat layer include phenoxy, epoxy, polyvinylpyrrolidone, polyvinyl alcohol, casein, polyacrylic acid, celluloses, gelatin, starch, polyurethane, polyimide and polyamide, and they can be used respectively alone or in a cured form with a curing agent. Among them, alcohol-soluble copolymerized polyamide, modified polyamide or the like is preferred in that it exhibits good dispersibility and coating property.

The ratio of addition of the inorganic particles to the binder resin to be used for the undercoat layer can be optionally selected, but it is preferably in the range of from 10 wt % to 500 wt % in view of the stability and the coating property of the dispersion liquid.

The thickness of the undercoat layer can be optionally selected, but it is preferably from 0.1 μm to 20 μm in view of the photoreceptor characteristics and the coating property. Further, a known antioxidant or the like may also be added to the undercoat layer. The photosensitive layer formed on the electroconductive substrate is preferably a lamination type comprising two layers i.e. a charge generation layer having the charge generation material dispersed in the binder resin and a charge transport layer having the charge transport material dispersed in the binder resin.

(Charge Generation Material)

As the charge generation material, selenium and alloys thereof, cadmium sulfide, and other inorganic photoconductive materials, and various photoconductive is materials including organic pigments such as phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments and benzimidazole pigments may be used. The organic pigments are particularly preferred, and phthalocyanine pigments and azo pigments are more preferred. The fine particles of these charge generation materials are bound by various binder resins such as polyester resin, polyvinyl acetate, polyacrylic acid ester, polymethacrylic acid ester, polyester, polycarbonate, polyvinyl acetoacetal, polyvinyl propional, polyvinyl butyral, phenoxy resin, epoxy resin, urethane resin, cellulose ester and cellulose ether to be used. In the case of the lamination type photoreceptor, the amount of the charge generation material to be used is from 30 to 500 parts by weight, preferably from 40 to 200 parts by weight per 100 parts by weight of the binder resin. Further, the thickness is usually from 0.1 μm to 1 μm, preferably from 0.15 μm to 0.6 μm.

In a case where a phthalocyanine compound is used as the charge generation material, specifically, metal-free phthalocyanine; or various crystal forms of phthalocyanines in which metals such as copper, indium, gallium, tin, titanium, zinc, vanadium, silicon and germanium, or oxides thereof, halides thereof, hydroxides thereof, alkoxides thereof, or the like are coordinated, may be used. Particularly, high-sensitivity crystal form X-form, τ-form metal-free phthalocyanines; A-form (alias β-form), B-form (alias α-form), D-form (alias Y-form) or the like of titanyl phthalocyanine (alias oxytitanium phthalocyanine), vanadyl phthalocyanine, chloroindium phthalocyanine; II-type or the like of chlorogallium phthalocyanine; V-type or the like of hydroxygallium phthalocyanine; G-type, 1-type or the like of μ-oxo-gallium phthalocyanine dimer; or II-type or the like of μ-oxo-aluminium phthalocyanine dimer are preferred. Among theses phthalocyanines, particularly preferred are A-form (β-form), B-form (α-form) and D-form (Y-form) showing a distinct peak at a Bragg angle (2θ±0.2°) of 27.3° in powder X-ray diffraction spectrum, of titanyl phthalocyanine, II-type of chlorogallium phthalocyanine, V-type of hydroxygallium phthalocyanine, and G-type of μ-oxo-gallium phthalocyanine dimmer.

Among them, preferred are crystal form oxytitanium phthalocyanine showing a peak at a Bragg angle (2θ±0.2°) of 27.3° in X-ray diffraction spectrum to CuKα characteristic X-ray, and crystal-form oxytitanium phthalocyanine showing peaks at Bragg angles (2θ±0.2°) of 9.5°, 24.1° and 27.3°. The crystal form oxytitanium phthalocyanine is particularly preferably one prepared by an acid paste treatment with sulfuric acid. Chlorine-substituted titanyl phthalocyanine may be contained, but is its amount is preferably small, and preferred is one containing it in an amount of at most 0.005 based on titanyl phthalocyanine by the intensity ratio in a mass spectrum. Further, it is preferred to use a material prepared by using a non-halogen compound. From the viewpoint of crystal stability, it is preferred to use a material prepared by using diphenylmethane as a reaction solvent.

In a case where oxytitanium phthalocyanine is contained in the photosensitive layer, the ratio of the weight of the compound represented by the formula (1) to the weight content of all binder resins is preferably from 0.15 to 0.9, particularly preferably from 0.2 to 0.6, more preferably from 0.3 to 0.5. In the case of a lamination type photosensitive layer containing no oxytitanium phthalocyanine in the photosensitive layer, the ratio of the weight of the compound represented by the formula (1) to the weight content of all binder resins is preferably from 0.15 to 0.6, particularly preferably from 0.2 to 0.55, more preferably from 0.3 to 0.5.

The phthalocyanine compounds may be used alone or in as mixture or in a mixed crystal of some thereof. The phthalocyanine compounds in a crystalline state may be obtained by mixing respective constituents afterwards, or by causing the mixed state in the manufacturing and treatment process of the phthalocyanine compounds, such as preparation, formation into pigment or crystallization. As such treatment, an acid paste treatment, a grinding treatment, a solvent treatment or the like is known. To cause a mixed crystal state, a method may be known comprising mixing two type of crystals, mechanically grinding the mixture into an undefined form, and then converting the mixture to a specific crystal state by a solvent treatment, as disclosed in JP-A-10-48859.

In a case where an azo pigment is used as the charge generation material, various known bisazo pigments and trisazo pigments are suitably used.

(Antioxidant)

It is also preferred that the photosensitive layer which the electrophotographic photoreceptor of the present invention has contains an antioxidant. The antioxidant is added to prevent oxidation of materials contained in the photosensitive layer. The antioxidant is preferably one having a function as a radical scavenger, and it may, for example, be specifically a phenol derivative, an amine compound, a phosphonate, a sulfur compound, vitamins or a vitamin derivative. Among them, a phenol derivative, an amine compound, vitamins or the like is preferred. More preferred is a hindered phenol having a bulky substituent near the hydroxyl group or a trialkylamine derivative. Among them, an aryl compound derivative having a t-butyl group at the 2-position relative to the hydroxyl group is preferably used, and particularly, an aryl compound derivative having two t-butyl groups at the 2-position relative to the hydroxyl group is preferred.

Further, if the molecular weight of the antioxidant is too high, the antioxidant function may be impaired, and accordingly a compound having a molecular weight of at most 1,500 is preferred, and a compound having a molecular weight of at most 1,000 is more preferred. Further, from the same reason, a compound having a molecular weight of at least 100 is preferred, and the molecular weight is more preferably at least 150, particularly preferably at least 200.

The antioxidant to be used in the present invention may be one known as an antioxidant, an ultraviolet absorber or a light stabilizer for plastics, rubber, petroleum and fats and fatty oils. Especially, a material selected from the following group of compounds may be preferably used, but the antioxidant which can be used for the electrophotographic photoreceptor of the present invention is not limited thereto.

(1) Phenols disclosed in JP-A-57-122444, phenol derivatives disclosed in JP-A-60-188956 and hindered phenols disclosed in JP-A-63-18356.
(2) Paraphenylenediamines disclosed in JP-A-57-122444, paraphenylenediamine derivatives disclosed in JP-A-60-188956 and paraphenylenediamines disclosed in JP-A-63-18356.
(3) Hydroquinones disclosed in JP-A-57-122444, hydroquinone derivatives disclosed in JP-A-60-188956 and hydroquinones disclosed in JP-A-63-18356.
(4) Sulfur compounds disclosed in JP-A-57-188956 and organic sulfur compounds disclosed in JP-A-63-18356.
(5) Organic phosphorus compounds disclosed in JP-A-57-122444 and organic phosphorus compounds disclosed in JP-A-63-18356.
(6) Hydroxyanisoles disclosed in JP-A-57-122444.
(7) Piperidine derivatives and oxopiperazine derivatives having a specific skeleton structure disclosed in JP-A-63-18355.
(8) Carotenes, amines, tocopherols, Ni(II) complexes, sulfides and the like disclosed in JP-A-60-188956.

Further, particularly preferred are the following hindered phenols having a bulky substituent near the hydroxyl group. Dibutylhydroxytoluene, 2,2'-methylenebis(6-t-butyl-4-methylphenol), 4,4'-butylidenebis(6-t-butyl-3-methylphenol), 4,4'-thiobis(6-t-butyl-3-methylphenol), 2,2'-butylidenebis(6-t-butyl-4-methylphenol), α-tocopherol, β-tocopherol, 2,2,4-trimethyl-6-hydroxy-7-t-butylchroman, pentaerythritoltetrakis[3-(3,5-di-t-butyl-4-hydroxyphenyl)propionate], 2,2'-thiodiethylenebis[3-(3,5-di-t-butyl-4-hydroxyphenyl) propionate], 1,6-hexanediol bis[3-(3,5-di-t-butyl-4-hydroxyphenyl)propionate], butylhydroxyanisole and dibutylhydroxyanisole.

Further, among the hindered phenols, particularly preferred is octadecyl-3,5-di-t-butyl-4-hydroxyhydrocinnamate (Irganox1076, tradename, manufactured by Ciba Geigy).

Such compounds are known as antioxidants for rubbers, plastics, fats and fatty oils, etc., and some of them are commercially available.

In the photoreceptor of the present invention, the amount of the antioxidant in the surface layer is not particularly limited, and it is preferably at least 0.1 part by weight and at most 20 parts by weight per 100 parts by weight of the binder resin. No favorable electric characteristics may be obtained in some cases if the amount is out of this range. It is particularly preferably at least 1 part by weight so as to sufficiently obtain the effects of the antioxidant. Further, if the amount is too large, not only the electric characteristics but also printing resistance may be impaired in some cases, and accordingly it is preferably at most 15 parts by weight, more preferably at most 10 parts by weight.

(Additives)

To the photosensitive layer, known additives such as a plasticizer, an ultraviolet absorber, an electron-withdrawing compound and a leveling agent for improving the film-forming properties, flexibility, coating property, stain resistance, gas resistance, lightfastness, and the like, may be incorporated. On the photosensitive layer, a protective layer may be provided for the purpose of preventing the wear of the photosensitive layer, or preventing or reducing the deterioration of the photosensitive layer due to the discharge product or the like arising from a charger or the like. Further, the surface layer thereof may also contain a fluororesin, a silicone resin or the like for the purpose of reducing the frictional resistance or the abrasion on the surface of the photoreceptor. Further, it may also contain particles comprising such a resin or particles of an inorganic compound.

(Method for Forming Photosensitive Layer)

The respective layers constituting the photoreceptor are formed by sequentially applying coating liquids obtained by dissolving or dispersing the respective materials to be contained in a solvent to the substrate by a known method such as dip coating, spray coating, nozzle coating, bar coating, roll coating or blade coating.

The solvent or dispersion medium to be used for preparation of the coating liquid may, for example, be an alcohol such as methanol, ethanol, propanol or 2-methoxyethanol; an ether such as tetrahydrofuran, 1,4-dioxane or dimethoxyethane; an ester such as methyl formate or ethyl acetate; a ketone such as acetone, methyl ethyl ketone or cyclohexanone; an aromatic hydrocarbon such as benzene, toluene or xylene; a chlorinated hydrocarbon such as dichloromethane, chloroform, 1,2-dichloroethane, 1,1,2-trichloroethane, 1,1,1-trichloroethane, tetrachloroethane, 1,2-dichloropropane or trichloroethylene; a nitrogen-containing compound such as n-butylamine, isopropanolamine, diethylamine, triethanolamine, ethylenediamine or triethylenediamine; or an aprotic polar solvent such as acetonitrile, N-methylpyrrolidone, N,N-dimethylformamide or dimethyl sulfoxide. They may be used alone or in combination of two or more of them. In preparation of the coating liquid or the dispersion liquid, in the case of the charge generation layer in the lamination type photosensitive layer, the solid content concentration is preferably at most 15 wt %, more preferably from 1 to 10 wt %, and the viscosity is from 0.1 to 10 mPa·s, more preferably from 1 to 5 mPa·s.

(Image Forming Apparatus)

Now, the embodiment of an image forming apparatus employing the electrophotographic photoreceptor of the present invention will be described with reference to FIG. 1 illustrating a structure of a substantial part of the apparatus. However, the embodiment is not limited to the following description, and various changes and modifications can be made without departing from the spirit and scope of the present invention.

As shown in FIG. 1, the image forming apparatus comprises an electrophotographic photoreceptor 1, a charging apparatus 2, an exposure apparatus 3 and a developing apparatus 4, and it further has a transfer apparatus 5, a cleaning apparatus 6 and a fixing apparatus 7 as the case requires.

The electrophotographic photoreceptor 1 is not particularly limited so long as it is the above-described electrophotographic photoreceptor of the present invention, and in FIG. 1, as one example thereof, a drum form photoreceptor comprising a cylindrical electroconductive substrate and the above-described photosensitive layer formed on the surface of the substrate. Along the outer peripheral surface of the electrophotographic photoreceptor 1, the charging apparatus 2, the exposure apparatus 3, the developing apparatus 4, the transfer apparatus 5 and the cleaning apparatus 6 are disposed.

The charging apparatus 2 is to charge the electrophotographic photoreceptor 1, and uniformly charges the surface of the electrophotographic photoreceptor 1 to a predetermined potential. In FIG. 1, as one example of the charging apparatus 2, a roller type charging apparatus (charging roller) is shown, and in addition, a corona charging apparatus such as corotron or scorotron, a contact charging apparatus such as a charging brush, and the like are used. It is possible to reduce generation of oxidizing gas such as ozone by charging using a contact charging apparatus, but cracking on the photosensitive layer or the like is likely to occur. It is particularly preferred that the compound represented by the formula (1) is contained in the photosensitive layer, whereby cracking on the photosensitive layer or the like is less likely to occur even by charging using a contact charging apparatus (charger of contact charging system).

The electrophotographic photoreceptor 1 and the charging apparatus 2 are designed to be removable from the main body of the image forming apparatus, in the form of a cartridge comprising both (hereinafter sometimes referred to as a photoreceptor cartridge) in many cases. And when the electrophotographic photoreceptor 1 or the charging apparatus 2 is deteriorated for example, the photoreceptor cartridge can be taken out from the main body of the image forming apparatus and another new photoreceptor cartridge can be attached to the main body of the image forming apparatus. Further, the toner as described hereinafter is stored in a toner cartridge and is designed to be removable from the main body of the image forming apparatus in many cases. When the toner in the toner cartridge used is consumed, the toner cartridge can be taken out from the main body of the image forming apparatus, and another new toner cartridge can be attached. Further, a cartridge comprising all the electrophotographic photoreceptor 1, the charging apparatus 2 and the toner may be used in some cases.

The type of the exposure apparatus 3 is not particularly limited so long as the electrophotographic photoreceptor 1 is exposed to form an electrostatic latent image on the photosensitive surface of the electrophotographic photoreceptor 1. Specific examples thereof include a halogen lamp, a fluorescent lamp, a laser such as a semiconductor laser or a He—Ne laser and LED. Further, exposure may be carried out by a photoreceptor internal exposure method. The light for the exposure is optional, and exposure may be carried out with a monochromatic light having a wavelength of from 700 nm to 850 nm, a monochromatic light slightly leaning to short wavelength side having a wavelength of from 600 nm to 700 nm, a short wavelength monochromatic light having a wavelength of from 300 nm to 500 nm or the like. Particularly in the case of en electrophotographic photoreceptor using a phthalocyanine compound as the charge generation material, it is preferred to use a monochromatic light having a wavelength of from 700 nm to 850 nm, and in the case of an electrophotographic photoreceptor using an azo compound, it is preferred to use a monochromatic light having a wavelength of at most 700 nm. In the case of an electrophotographic photoreceptor using the azo compound represented by the formula (4) according to the present invention as the charge generation material, it has sufficient sensitivity even when a monochromatic light having a wavelength of at most 500 nm is used as a light input source, whereby it is particularly preferred to use a monochromatic light having a wavelength of from 300 nm to 500 nm as a light input source.

The type of the developing apparatus 4 is not particularly limited, and an optional apparatus of e.g. a dry development method such as cascade development, single component conductive toner development or two component magnetic brush development or a wet development method may be used. In FIG. 1, the developing apparatus 4 comprises a developing tank 41, an agitator 42, a supply roller 43, a developing roller 44 and a control member 45, and a toner T is stored in the developing tank 41. Further, as the case requires, the developing apparatus 4 may have a supply apparatus (not shown) which supplies the toner T. The supply apparatus is constituted so that the toner T can be supplied from a container such as a bottle or a cartridge.

The supply roller 43 is formed from e.g. an electrically conductive sponge. The developing roller 44 is a metal roll of e.g. iron, stainless steel, aluminum or nickel or a resin roll having such a metal roll covered with a silicon resin, a urethane resin, a fluororesin or the like. A smoothing treatment or a roughening treatment may be applied to the surface of the is developing roller 44 as the case requires.

The developing roller 44 is disposed between the electrophotographic photoreceptor 1 and the supply roller 43, and is in contact with each of the electrophotographic photoreceptor 1 and the supply roller 43. The supply roller 43 and the developing roller 44 are rotated by a rotation driving mechanism (not shown).

The supply roller 43 supports the stored toner T and supplies it to the developing roller 44. The developing roller 44 supports the toner T supplied by the supply roller 43 and brings it into contact with the surface of the electrophotographic photoreceptor 1.

The control member 45 is formed by a resin blade of e.g. a silicone resin or a urethane resin, a metal blade of e.g. stainless steel, aluminum, copper, brass or phosphor bronze, or a blade having such a metal blade covered with a resin. The control member 45 is in contact with the developing roller 44, and is pressed under a predetermined force to the side of the developing roller 44 by e.g. a spring (general blade linear pressure is from 5 to 500 g/cm$^2$). As the case requires, the control member 45 may have a function to charge the toner T by means of frictional electrification with the toner T.

The agitator 42 is rotated by a rotation driving mechanism, and stirs the toner T and transports the toner T to the supply roller 43. A plurality of agitators 42 with different blade shapes or sizes may be provided.

The type of the toner T is optional, and in addition to a powdery toner, a polymerized toner obtained by means of e.g. suspension polymerization or emulsion polymerization, and the like, may be used. Particularly when a polymerized toner is used, preferred is one having small particle sizes of from about 4 to about 8 μm, and with respect to the shape of particles of the toner, nearly spherical particles and particles which are not spherical, such as potato-shape particles, may be variously used. The polymerized toner is excellent in charging uniformity and transfer properties, and is favorably used to obtain a high quality image.

The type of the transfer apparatus 5 is not particularly limited, and an apparatus of optional method such as an electrostatic transfer method such as corona transfer, roller transfer or belt transfer, a pressure transfer method or an adhesive transfer method may be used. In this case, the transfer apparatus 5 comprises a transfer charger, a transfer roller, a transfer belt and the like which are disposed to face the electrophotographic photoreceptor 1. The transfer apparatus 5 applies a predetermined voltage (transfer voltage) at a polarity opposite to the charge potential of the toner T and transfers a toner image formed on the electrophotographic photoreceptor 1 to a recording paper (paper sheet, medium) P.

The cleaning apparatus 6 is not particularly limited, and an optional cleaning apparatus such as a brush cleaner, a magnetic brush cleaner, an electrostatic brush cleaner, a magnetic roller cleaner or a blade cleaner may be used. The cleaning apparatus 6 is to scrape away the remaining toner attached to the photoreceptor 1 by a cleaning member and to recover the remaining toner. If there is no or little toner remaining on the photoreceptor, the cleaning apparatus 6 is not necessarily provided.

The fixing apparatus 7 comprises an upper fixing member (pressure roller) 71 and a lower fixing member (fixing roller) 72, and a heating apparatus 73 is provided in the interior of the fixing member 71 or 72. FIG. 1 illustrates an example wherein the heating apparatus 73 is provided in the interior of the upper fixing member 71. As each of the upper and lower fixing members 71 and 72, a known heat fixing member such as a fixing roll comprising a metal cylinder of e.g. stainless steel or aluminum covered with a silicon rubber, a fixing roll further covered with Teflon (registered trademark) or a fixing sheet may be used. Further, each of the fixing members 71 and 72 may have a structure to supply a release agent such as a silicone oil so as to improve the releasability, or may have a structure to forcibly apply a pressure to each other by e.g. a spring.

The toner transferred on the recording paper P is heated to a molten state when it passes through the upper fixing member 71 and the lower fixing member 72 heated to a predetermined temperature, and then cooled after passage and fixed on the recording paper P.

The type of the fixing apparatus is also not particularly limited, and one used in this case, and further, a fixing apparatus by an optional method such as heated roller fixing, flash fixing, oven fixing or pressure fixing may be provided.

In the electrophotographic apparatus constituted as mentioned above, recording of an image is carried out as follows. Namely, the surface (photosensitive surface) of the photoreceptor 1 is charged to a predetermined potential (−600 V for example) by the charging apparatus 2. In this case, it may be charged by a direct voltage or may be charged by superposing an alternating voltage to a direct voltage.

Then, the charged photosensitive surface of the photoreceptor 1 is exposed by means of the exposure apparatus 3 in accordance with the image to be recorded to form an electrostatic latent image on the photosensitive surface. Then, the electrostatic latent image formed on the photosensitive surface of the photoreceptor 1 is developed by the developing apparatus 4.

The developing apparatus 4 forms the toner T supplied by the supply roller 43 into a thin layer by the control member (developing blade) 45 and at the same time, charges the toner T to a predetermined polarity (in this case, the same polarity as the charge potential of the photoreceptor 1 and negative polarity) by means of frictional electrification, transfers it while supporting it by the developing roller 44 and brings it into contact with the surface of the photoreceptor 1.

When the charged toner T supported by the developing roller 44 is brought into contact with the surface of the photoreceptor 1, a toner image corresponding to the electrostatic latent image is formed on the photosensitive surface of the photoreceptor 1. Then, the toner image is transferred to the recording paper P by the transfer apparatus 5. Then, the toner remaining on the photosensitive surface of the photoreceptor 1 without being transferred is removed by the cleaning apparatus 6.

After the toner image is transferred to the recording paper P, the recording paper P is made to pass through the fixing apparatus 7 so that the toner image is heat fixed on the recording paper P, whereby an image is finally obtained.

The image forming apparatus may have a structure capable of carrying out a charge removal step in addition to the above-described structure. The charge removal step is a step of carrying out charge removal of the electrophotographic photoreceptor by exposing the electrophotographic photoreceptor, and as a charge removal apparatus, a fluorescent lamp or LED may, for example, be used. Further, the light used in the charge removal step, in terms of intensity, is a light having an exposure energy at least three times the exposure light in many cases.

Further, the image forming apparatus may have a further modified structure, and it may have, for example, a structure capable of carrying out a step such as a pre-exposure step or a supplementary charging step, a structure of carrying out offset printing or a full color tandem structure employing plural types of toners.

EXAMPLES

Now, the present invention will be described in further detail with reference to Examples, but the present invention is by no means restricted thereto without departing from the intension and the scope of the present invention.

Preparation Example 1A

Preparation of Exemplified Compound 1

15.1 g of 4,4'-diformyltriphenylamine and 30.4 g of diethyl 1,1-diphenylmethylphosphonate were dissolved in 0.1 L of dimethylformamide (hereinafter sometimes abbreviated as DMF), and 16.8 g of potassium t-butoxide was added at from 25° C. to 35° C. After addition, stirring was carried out at room temperature for 3 hours. The reaction liquid was dispersed in 0.2 L of methanol, the precipitated solid was collected by filtration, and the obtained solid was dissolved in DMF again and purified by silica gel column chromatography to obtain 28 g of exemplified compound 1.

As a result of analysis by high performance liquid chromatography (mobile phase: acetonitrile, column: Inertsil ODS-3V manufactured by GL Sciences Inc.), 99 mol % or more of all stereoisomers regarding double bonds (a), (b), (c) and (d) represented by the formula (2), were a trans-form.

Preparation Example 1B

Preparation of Exemplified Compound 1

15.1 g of 4,4'-diformyltriphenylamine, 25 g of diethyl 1,1-diphenylmethylphosphonate and 10 g of cinnamyltriphenylphosphonium chloride were dissolved in 1 L of DMF, and 16.8 g of potassium t-butoxide was added at from 25° C. to 35° C. After addition, stirring was carried out at room temperature for 3 hours. The reaction liquid was dispersed in 2 L of methanol, the precipitated solid was collected by filtration, and the obtained solid was dissolved in DMF again and purified by silica gel column chromatography to obtain 25 g of exemplified compound 1.

As a result of analysis by high performance liquid chromatography (mobile phase: acetonitrile, column: Inertsil ODS-3V manufactured by GL Sciences Inc.), 74 mol % of stereoisomers regarding double bonds (a) and (b) represented by the formula (2) were a trans-form, and 98 mol % or more of stereoisomers regarding double bonds (c) and (d) were a trans-form.

Preparation Example 1C

Preparation of Exemplified Compound 1

15.1 g of 4,4'-diformyltriphenylamine and 40 g of cinnamyltriphenylphosphonium chloride were dissolved in 0.1 L of a DMF/toluene mixed solution (DMF:toluene=2:1), and a sodium methoxide methanol solution was added at from 25° C. to 35° C. After addition, stirring was carried out at room temperature for 3 hours. The reaction liquid was dispersed in 2 L of methanol, the precipitated solid was collected by filtration, and the obtained solid was dissolved in DMF again and purified by silica gel column chromatography to obtain 25 g of exemplified compound 1.

As a result of high performance liquid chromatography (mobile phase: acetonitrile, column: Inertsil ODS-3V manufactured by GL Sciences Inc.), 45 mol % of stereoisomers regarding double bonds (a) and (b) represented by the formula (2) were a trans-form and 98 mol % or more of stereoisomers regarding double bonds (c) and (d) were a trans-form.

Preparation Example 1D

Preparation of Exemplified Compound 1

15.1 g of 4,4'-diformyltriphenylamine and 40 g of cinnamyltriphenylphosphonium chloride were dissolved in 0.1 L of DMF, and a sodium methoxide methanol solution was added at from 25° C. to 35° C. After addition, stirring was carried out at room temperature for 3 hours. The reaction liquid was dispersed in 2 L of methanol, and it was attempted to collect the precipitated solid by filtration, but the solid became gummy. Accordingly the crude (unpurified) product was purified by silica gel column chromatography as it was to obtain 20 g of exemplified compound 1. As a result of analysis by high performance liquid chromatography (mobile phase: acetonitrile, column ODS-3V), in the formula (2), on an average of 24 mol % of geometric isomers regarding (a) and (b) were a trans-form, and on an average of 98 mol % or more of geometric isomers regarding (c) and (d) were a trans-form.

Preparation Example 2A

Preparation of Exemplified Compound 2

Exemplified compound 2 was prepared in the same manner as in Preparation Example 1A except that 4,4'-diformyl-4"-methyltriphenylamine was used instead of 4,4'-diformyltriphenylamine. In the formula (2), 99 mol % or more of all geometric isomers regarding (a), (b), (c) and (d) were a trans-form.

Preparation Example 2B

Preparation of Exemplified Compound 2

Exemplified compound 2 was prepared in the same manner as in Preparation Example 1B except that 4,4'-diformyl-4"-methyltriphenylamine was used instead of 4,4'-diformyltriphenylamine. In the formula (2), on an average of 85 mol % of geometric isomers regarding (a) and (b) were a trans-form, and on an average of 98 mol % or more of geometric isomers regarding (c) and (d) were a trans-form.

Preparation Example 3A

Preparation of Exemplified Compound 3

Exemplified compound 3 was prepared in the same manner as in Preparation Example 1A except that 4,4'-diformyl-4"-isopropyltriphenylamine was used instead of 4,4'-diformyltriphenylamine. In the formula (2), 99 mol % of all geometric isomers regarding (a), (b), (c) and (d) were a trans-form.

Preparation Example 3B

Preparation of Exemplified Compound 3

Exemplified compound 3 was prepared in the same manner as in Preparation Example 1A except that 4,4'-s diformyl-4"-isopropyltriphenylamine was used instead of 4,4'-diformyltriphenylamine and that a DMF/toluene=½ (weight ratio) mixed solution was used instead of the DMF/toluene=2/1 (weight ratio) mixed solution. In the formula (2), on an average of 89 mol % of geometric isomers regarding (a) and (b) were a trans-form, and on an average of 98 mol % or more of geometric isomers regarding (c) and (d) were a trans-form.

Comparative Preparation Example 1

A charge transport material composition (hereinafter sometimes abbreviated as charge transport material X) was prepared in accordance with Preparation Example (3) disclosed in JP-A-2005-134709. In the charge transport material X, a compound represented by the exemplified compound 2 was contained in an amount of about 30% based on the entire composition by the peak area ratio by gel permeation chromatography using a UV detector at a wavelength of 254 nm, and the peak area ratio of the compound represented by the exemplified compound 2 to a compound contained in the charge transport material X in the maximum amount was about 60%.

Example 1

For Preparation of Charge Generation Material

β-Form oxytitanium phthalocyanine was prepared in accordance with "Example for preparation of crude TiOPc" and "Example 1" in JP-A-10-7925. 18 parts by weight of the obtained p-form oxytitanium phthalocyanine and 720 parts by weight of 95% concentrated sulfuric acid cooled at −10° C. or below were mixed. On that occasion, the β-form oxytitanium phthalocyanine was slowly added so that the temperature of the sulfuric acid solution would not exceed −5° C. After completion of mixing, the concentrated sulfuric acid solution was stirred at −5° C. or below for 2 hours, and after stirring, the concentrated sulfuric acid solution was subjected to filtration by sintered glass filter. The insoluble matter was collected by filtration and then dispersed in 10,800 parts by weight of ice water to precipitate oxytitanium phthalocyanine, and after dispersion, stirring was carried out for one hour. After stirring, the solution was removed by filtration, and the obtained wet cake and 900 parts by weight of water were mixed for one hour, followed by filtration. This operation was repeated until the ionic conductivity of the filtrate became 0.5 mS/m to obtain 185 parts by weight of a wet cake of low crystalline oxytitanium phthalocyanine (oxytitanium phthalocyanine content: 9.5 wt %).

93 Parts by weight of the obtained wet cake of low crystalline oxytitanium phthalocyanine and 190 parts by weight of water were mixed, followed by stirring at room temperature for 30 minutes. Then, 39 parts by weight of o-dichlorobenzene was added to the mixed solvent, followed by stirring at room temperature further for one hour. After stirring, water was separated, and 134 parts by weight of MeOH was added, followed by stirring and cleaning at room temperature for one hour. After cleaning, water was removed by filtration, stirring and washing were carried out again using 134 parts by weight of MeOH for one hour, and then water was removed by filtration, followed by drying by heating in a vacuum dryer to obtain 7.8 parts by weight of oxytitanium phthalocyanine showing chief diffraction peaks at Bragg angles (2θ±0.2°) of 9.5°, 24.1° and 27.2° to CuKα characteristic X-ray (wavelength: 1.541 Å) (hereinafter sometimes abbreviated as charge generation material 1). The content of chlorooxytitanium phthalocyanine contained in the obtained oxytitanium phthalocyanine was measured by a means (mass spectrometry) disclosed in JPA-2001-115054 and as a result, the intensity ratio was at most 0.003 relative to oxytitanium phthalocyanine.

Example 2

For Preparation of Charge Generation Material

3 Parts by weight of oxytitanium phthalocyanine showing chief diffraction peaks at Bragg angles (2θ±0.2°) of 9.5°, 24.1° and 27.2° to CuKα characteristic X-ray (wavelength: 1.541 Å) (hereinafter sometimes abbreviated as charge generation material 2) was obtained in the same manner as in Example 1 for preparation of charge generation material except that 50 parts by weight of the wet cake of low crystalline oxytitanium phthalocyanine obtained in Example 1 for preparation of charge generation material was dispersed in 500 parts by weight of tetrahydrofuran (hereinafter sometimes abbreviated as THF), followed by stirring at room temperature for one hour.

The content of chlorooxytitanium phthalocyanine contained in the obtained oxytitanium phthalocyanine was measured by a means (mass spectrometry) disclosed in JP-A-2001-115054 and as a result, the intensity ratio was at most 0.003 relative to oxytitanium phthalocyanine.

Example 3

For Preparation of Charge Generation Material

3 Parts by weight of oxytitanium phthalocyanine showing chief diffraction peaks at Bragg angles (2θ±0.2° of 9.5°, 24.1° and 27.2° to CuKα characteristic X-ray (wavelength: 1.541 Å) (hereinafter sometimes abbreviated as charge generation material 3) was obtained in the same manner as in Example 1 for preparation of charge generation material except that β-form oxytitanium phthalocyanine prepared by the method disclosed in Example 1 in JP-A-2001-115054 was used as the β-form oxytitanium phthalocyanine.

The content of chlorooxytitanium phthalocyanine contained in the obtained oxytitanium phthalocyanine was measured by a means (mass spectrometry) disclosed in JP-A-2001-115054 and as a result, the intensity ratio was 0.05 relative to oxytitanium phthalocyanine.

Preparation of Photoreceptors A1 to A23 and P1 to P16

Example 1

Parts by weight of the oxytitanium phthalocyanine obtained in Example 1 for preparation of charge generation material and 150 parts by weight of 4-methoxy-4-methyl-2-pentanone were mixed, followed by grinding and dispersion treatment by a sand grinding mill for one hour to prepare a pigment dispersion liquid.

Further, 100 parts by weight of a 1,2-dimethoxyethane solution of polyvinyl butyral (Denka Butyral #6000C, tradename, manufactured by Denki Kagaku Kogyo Kabushiki Kaisha) at a concentration of 5 wt % and 100 parts by weight of a 1,2-dimethoxyethane solution of a phenoxy resin (PKHH, tradename, manufactured by Union Carbide) at a concentration of 5 wt % were mixed to prepare a binder resin solution.

160 Parts by weight of the above prepared pigment dispersion liquid, 100 parts by weight of the binder resin solution and a proper amount of 1,2-dimethoxyethane were mixed to prepare a coating liquid for formation of charge generation layer having a final solid content concentration of 4.0%.

The obtained dispersion liquid for formation of charge generation layer was applied to a polyethylene terephthalate film in a thickness of 75 μm having aluminum vapor deposited on its surface so that the film thickness would be 0.3 μm after drying to provide a charge generation layer.

Then, to the film, a liquid having 20 parts by weight of the exemplified compound 1 prepared in Preparation Example (1A), 20 parts by weight of compound (A) having the following structure:

Compound (A)

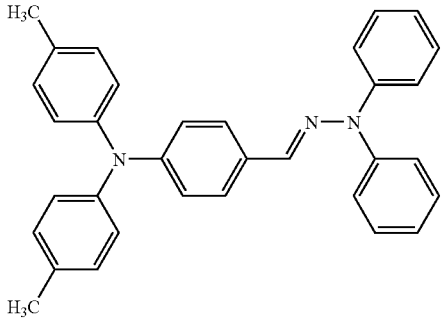

100 parts by weight of the following binder resin (B1) (m:n=51/49, viscosity average molecular weight: 30,000):

(B1)

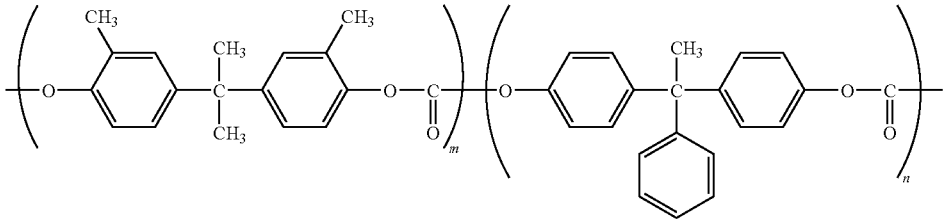

8 parts by weight of an antioxidant (IRGANOX1076, tradename, manufactured by Ciba Geigy) and 0.03 part by weight of a silicone oil as a leveling agent dissolved in 640 parts by weight of THF/toluene=8/2 (mixing weight ratio) (hereinafter sometimes referred to as a coating liquid for formation of charge transport layer) was applied and dried at 125° C. for 20 minutes to provide a charge transport layer so that the film thickness would be 20 μm after drying thereby to obtain an electrophotographic photoreceptor A1.

Example 2

An electrophotographic photoreceptor A2 was obtained in the same manner as in Example 1 except that the exemplified compound 1 prepared in Preparation Example (1B) was used instead of the exemplified compound 1 prepared in Preparation Example (1A) used in Example 1.

Example 3

An electrophotographic photoreceptor A3 was obtained in the same manner as in Example 1 except that 40 parts by weight of the exemplified compound 1 prepared in Preparation Example (1B) was used instead of the exemplified compound 1 prepared in Preparation Example (1A) used in Example 1.

Example 5

An electrophotographic photoreceptor A5 was obtained in the same manner as in Example 1 except that 15 parts by weight of the exemplified compound 2 prepared in Preparation Example (2A) was used instead of the exemplified compound 1 prepared in Preparation Example (1A) used in Example 1 and that 15 parts by weight of compound (B) was used instead of the compound (A):

Compound (B)

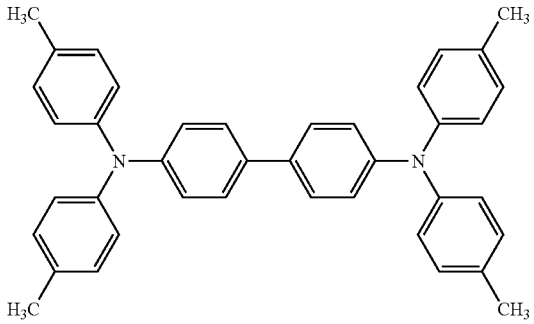

Example 6

An electrophotographic photoreceptor A6 was obtained in the same manner as in Example 5 except that 20 parts by weight of the exemplified compound 2 prepared in Preparation Example (2B) was used instead of the exemplified compound 2 prepared in Preparation Example (2A) used in Example 5, and that the amount of use of the compound (B) was 20 parts by weight.

Example 7

An electrophotographic photoreceptor A7 was obtained in the same manner as in Example 1 except that 20 parts by weight of the exemplified compound 3 prepared in Preparation Example (3A) was used instead of the exemplified compound 1 prepared in Preparation Example (1A) used in Example 1 and that 20 parts by weight of the is following compound (C) was used instead of the compound (A):

Compound (C)

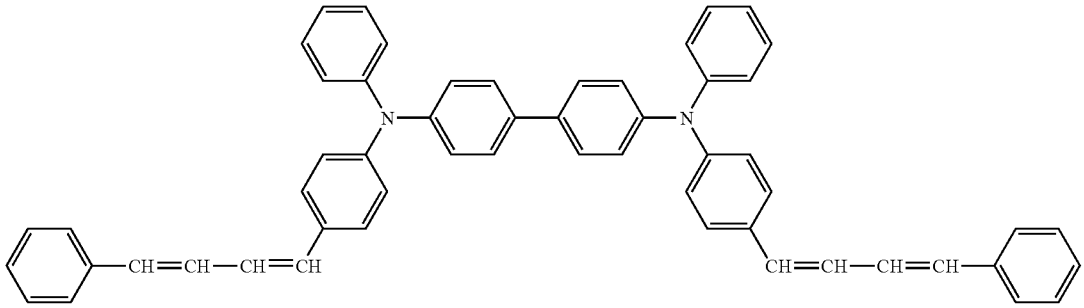

Example 8

An electrophotographic photoreceptor A8 was obtained in the same manner as in Example 7 except that 20 parts by weight of the compound (A) was used instead of the compound (C) used in Example 7.

Example 9

An electrophotographic photoreceptor A9 was obtained in the same manner as in Example 8 except that the compound (B) was used instead of the compound (A) used in Example 8.

Example 10

An electrophotographic photoreceptor A10 was obtained in the same manner as in Example 7 except that the amount of use of the exemplified compound 3 used in Example 7 was 50 parts by weight.

Example 11

An electrophotographic photoreceptor A11 was obtained in the same manner as in Example 7 except that the amount of use of the exemplified compound 3 used in Example 7 was 40 parts by weight, and that the amount of use of the compound (C) was 40 parts by weight.

Example 12

An electrophotographic photoreceptor A12 was obtained in the same manner as in Example 7 except that the amount of use of the compound (C) used in Example 7 was 50 parts by weight.

Example 13

An electrophotographic photoreceptor A13 was obtained in the same manner as in Example 7 except that the amount of use of the exemplified compound 3 used in Example 7 was 45 parts by weight, and that 50 parts by weight of the compound (B) was used instead of the compound (C).

Example 14

An electrophotographic photoreceptor A14 was obtained in the same manner as in Example 13 except that the compound (A) was used instead of the compound (B) used in Example 13.

Example 15

An electrophotographic photoreceptor A15 was obtained in the same manner as in Example 1 except that 50 parts by weight of the exemplified compound 3 prepared in Preparation Example (3B) was used instead of the exemplified compound 1 prepared in Preparation Example (1A) used in Example 1 and that no compound (A) was used.

Example 16

An electrophotographic photoreceptor A16 was is obtained in the same manner as in Example 1 except that 20 parts by weight of the exemplified compound 3 prepared in Preparation Example (3B) was used instead of the exemplified compound 1 prepared in Preparation Example (1A) used in Example 1 and that the compound (C) was used instead of the compound (A).

Example 17

An electrophotographic photoreceptor A17 was obtained in the same manner as in Example 16 except that the charge generation material 2 prepared in Example 2 for preparation of charge generation material was used instead of the charge generation material 1 prepared in Example 1 for preparation of charge generation material used in Example 16.

Example 18

An electrophotographic photoreceptor A18 was obtained in the same manner as in Example 16 except that the charge generation material 3 prepared in Example 3 for preparation of charge generation material was used instead of the charge generation material 1 prepared in Example 1 for preparation of charge generation material used in Example 16.

Example 19

An electrophotographic photoreceptor A19 was obtained in the same manner as in Example 7 except that the following binder resin (B2) (viscosity average molecular weight: 40,000) was used instead of the binder resin used in Example 7:

(B2)

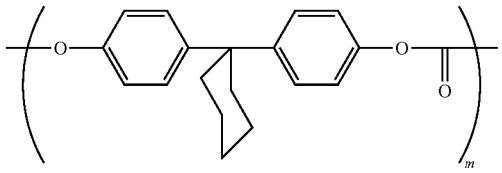

Example 20

An electrophotographic photoreceptor A20 was obtained in the same manner as in Example 7 except that the following binder resin (B3) (viscosity average molecular weight: 40,000, m:n=9:1) was used instead of the binder resin used in Example 7:

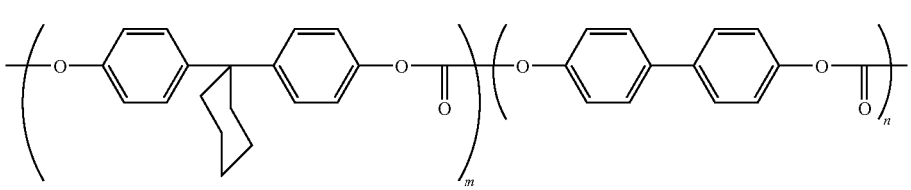

(B3)

Example 21

An electrophotographic photoreceptor A21 was obtained in the same manner as in Example 16 except that oxytitanium phthalocyanine obtained by the method disclosed in Preparation Example in JP-A-8-123052 (hereinafter sometimes abbreviated as charge generation material 4) was used instead of the oxytitanium phthalocyanine obtained in Example 1 for preparation of charge generation material used in Example 16.

Example 22

An electrophotographic photoreceptor A22 was obtained in the same manner as in Example 16 except that the amount of use of the exemplified compound 3 prepared in Preparation Example (3B) used in Example 16 was 90 parts by weight, and that the amount of use of the compound (C) was 10 parts by weight.

Example 23

An electrophotographic photoreceptor A23 was obtained in the same manner as in Example 22 except that the amount of use of the exemplified compound 3 prepared in Preparation Example (3B) used in Example 22 was 65 parts by weight.

Example 24

An electrophotographic photoreceptor A24 was obtained in the same manner as in Example 13 except that 40 parts by weight of the exemplified compound 1 prepared in Preparation Example (1A) was used instead of the exemplified compound 3 prepared in Preparation Example (3A) used in Example 13.

Comparative Example 1

An electrophotographic photoreceptor P1 was obtained in the same manner as in Example 15 except that 100 parts by weight of the exemplified compound 1 prepared in Preparation Example (1A) was used instead of the exemplified compound 3 prepared in Preparation Example (3B) used in Example 15, but deposition of crystals was confirmed on the entire surface of the photoreceptor.

Comparative Example 2

An electrophotographic photoreceptor P2 was obtained in the same manner as in Example 15 except that 100 parts by weight of the exemplified compound 2 prepared in Preparation Example (2A) was used instead of the exemplified compound 3 prepared in Preparation Example (3B) used in Example 15, but deposition of crystals was confirmed on the entire surface of the photoreceptor.

Comparative Example 4

An electrophotographic photoreceptor P4 was obtained in the same manner as in Example 15 except that 100 parts by weight of the exemplified compound 1 prepared in Preparation Example (1B) was used instead of the exemplified compound 3 prepared in Preparation Example (3B) used in Example 15, but deposition of crystals was confirmed at the edge of the photoreceptor.

Comparative Example 5

An electrophotographic photoreceptor P5 was obtained in the same manner as in Example 15 except that 100 parts by weight of the exemplified compound 1 prepared in Preparation Example (1D) was used instead of the exemplified compound 3 prepared in Preparation Example (3B) used in Example 15.

Comparative Example 6

An electrophotographic photoreceptor P6 was obtained in the same manner as in Example 1 except that the exemplified compound 1 prepared in Preparation Example (1A) used in Example 1 was used in an amount of 100 parts by weight instead of 20 parts by weight, but deposition of crystals was confirmed on a part of the edge of the photoreceptor.

Comparative Example 7

An electrophotographic photoreceptor P7 was obtained in the same manner as in Example 5 except that the exemplified compound 2 prepared in Preparation Example (2A) used in Example 5 was used in an amount of 100 parts by weight instead of 15 parts by weight, but deposition of crystals was confirmed on a part of the edge of the photoreceptor.

Comparative Example 8

An electrophotographic photoreceptor P8 was obtained in the same manner as in Example 5 except that the exemplified compound 2 prepared in Preparation Example (2A) used in Example 5 was used in an amount of 10 parts by weight instead of 15 parts by weight.

Comparative Example 10

An electrophotographic photoreceptor P10 was obtained in the same manner as in Example 15 except that the following compound (D) was used instead of the exemplified compound 3 prepared in Preparation Example (3B) used in Example 15:

(D)

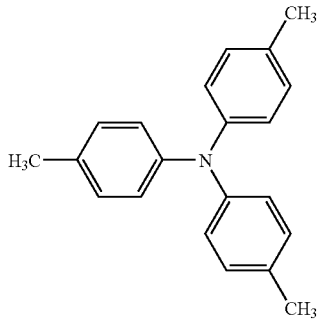

Comparative Example 11

An electrophotographic photoreceptor P11 was obtained in the same manner as in Example 15 except that the following compound (E) was used instead of the exemplified compound 3 prepared in Preparation Example (3B) used in Example 15:

(E)

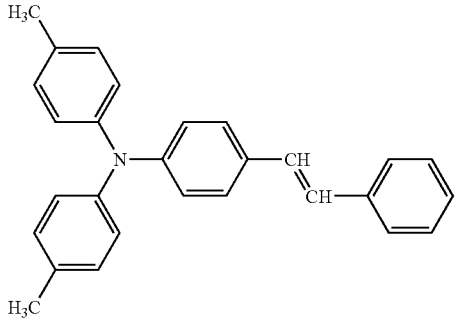

Comparative Example 12

An electrophotographic photoreceptor P12 was obtained in the same manner as in Example 15 except that the following compound (F) was used instead of the exemplified compound 3 prepared in Preparation Example (3B) used in Example 15:

(F)

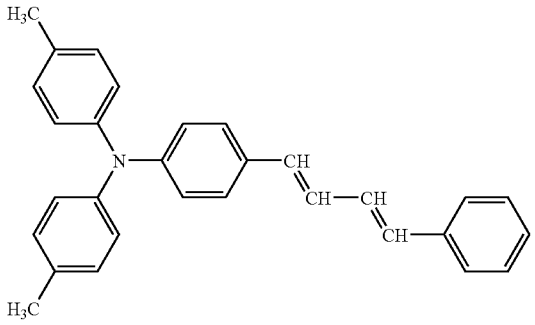

Comparative Example 13

An electrophotographic photoreceptor P13 was obtained in the same manner as in Example 15 except that the following compound (G) was used instead of the exemplified compound 3 prepared in Preparation Example (3B) used in Example 15:

(G)

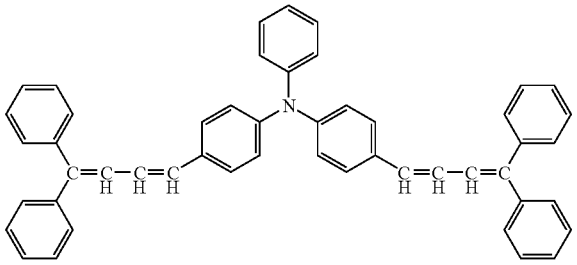

Comparative Example 14

An electrophotographic photoreceptor P14 was obtained in the same manner as in Example 15 except that the compound (C) was used instead of the exemplified compound 3 prepared in Preparation Example (3B) used in Example 15.

Comparative Example 15

It was attempted to obtain an electrophotographic photoreceptor P15 in the same manner as in Example 15 except that compound (H) was used instead of the exemplified compound 3 prepared in Preparation Example (3B) used in Example 15, but deposition was confirmed on the photoreceptor:

(H)

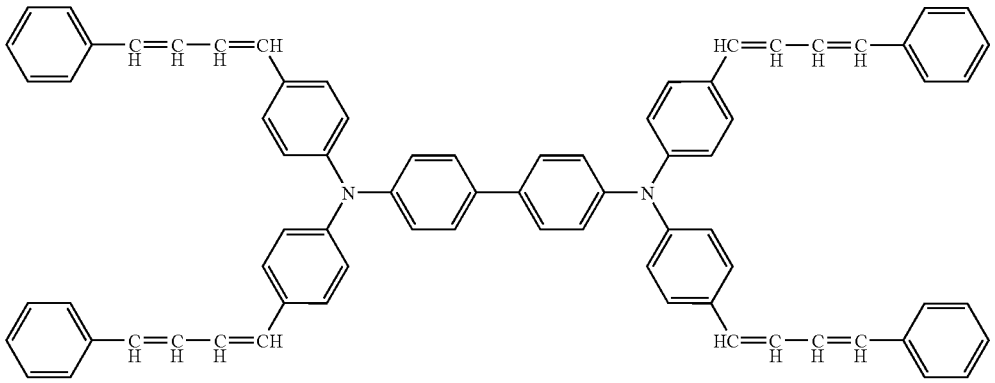

Comparative Example 16

An electrophotographic photoreceptor P16 was obtained in the same manner as in Example 15 except that the charge transport material X prepared in Comparative Preparation Example 1 was used instead of the exemplified compound 3 prepared in Preparation Example (3B) used in Example 15, but deposition of crystals was confirmed after the photoreceptor was left to stand at room temperature for one day.

(Evaluation Electric Characteristics of Photoreceptor)

By using an electrophotographic characteristic evaluation apparatus (described on pages 404 to 405 in "Electrophotography—Bases and applications, second series" edited by the Society of Electrophotography, Published by Corona Co.), manufactured in accordance with the measurement standard by the Society of Electrophotography, a test was carried out in the following manner. The photoreceptor (one week after the preparation) was stuck on a drum made of aluminum to be formed in cylinder, and the continuity between the drum made of aluminum and the aluminum substrate of the photoreceptor was ensured. Then, the drum was rotated at a constant rpm to perform the electric characteristic evaluation test by cycles of charging, exposure, potential measurement, and charge removal. In this step, the initial surface potential was set at −700 V, a 780-nm monochromatic light was used for the exposure and a 660-nm monochromatic light was used for the charge removal. The surface potential (VL) at the time of irradiation with 1.0 μJ/cm$^2$ of the 780-nm light, and the exposure amount (half decay exposure) required to bring the surface potential to −350 V as an index of the sensitivity, were measured. For measurement of the half decay exposure and VL, the time required for exposure-potential measurement was set at 100 ms. The measurements were carried out under the environment of a temperature of 25° C. and a relative humidity of 50% (environment N/N), and a temperature of 5° C. and a relative humidity of 10% (environment L/L). The smaller the sensitivity (half decay exposure) and the absolute value of the VL value, the better the electric characteristics. The results are shown in Table 1 (environment N/N) and Table 2 (environment L/L).

(Evaluation of Mobility)

A charge generation layer was prepared in the same manner as in Example 15. Then, to the film, a coating liquid for formation of charge transport layer having 20 parts by weight of the exemplified compound 3 prepared in Preparation Example (3A), 20 parts by weight of the compound (C), 100 parts by weight of the polycarbonate resin (B1) (m:n=51/49, viscosity average molecular weight: 30,000) and 0.03 part by weight of a silicone oil as a leveling agent dissolved in 640 parts by weight of THF was applied and dried at 125° C. for 20 minutes to form a charge transport layer so that the thickness would be 20 μm after drying thereby to obtain an electrophotographic photoreceptor M1.

Further, a photoreceptor MP1 was obtained in the same manner as in preparation of the photoreceptor M1 except that the amount of use of the compound (C) was 40 parts by weight for the charge transport layer.

The mobility of the charge transport layer of the obtained photoreceptor was measured in accordance with TOF (Time of flight) method by charge generation material excitation by exposure at 780 nm at 21±0.5° C. at 2.0×10$^5$ (V/cm). The obtained results are shown in Table 3.

TABLE 1

| Environment N/N | | | | | | |
|---|---|---|---|---|---|---|
| Photo-receptor No. | Half decay exposure μJ/cm$^2$ | VL (−V) | Charge transport material (Parts by weight) | | Binder | Charge generation material |
| A1 | 0.094 | 50 | 1A (20) | A (20) | B1 | 1 |
| A2 | 0.095 | 53 | 1B (20) | A (20) | B1 | 1 |
| A3 | 0.096 | 57 | 1B (40) | A (20) | B1 | 1 |
| A5 | 0.094 | 40 | 2A (15) | B (15) | B1 | 1 |
| A6 | 0.093 | 50 | 2B (20) | B (20) | B1 | 1 |
| A7 | 0.093 | 45 | 3A (20) | C (20) | B1 | 1 |
| A8 | 0.093 | 40 | 3A (20) | A (20) | B1 | 1 |
| A9 | 0.092 | 29 | 3A (20) | B (20) | B1 | 1 |
| A10 | 0.092 | 28 | 3A (50) | C (20) | B1 | 1 |
| A11 | 0.092 | 30 | 3A (40) | C (40) | B1 | 1 |
| A12 | 0.093 | 42 | 3A (20) | C (50) | B1 | 1 |
| A13 | 0.089 | 27 | 3A (45) | B (50) | B1 | 1 |
| A14 | 0.094 | 41 | 3A (45) | A (50) | B1 | 1 |
| A15 | 0.095 | 41 | 3B (50) | Nil | B1 | 1 |
| A16 | 0.093 | 45 | 3B (20) | C (20) | B1 | 1 |
| A17 | 0.092 | 43 | 3B (20) | C (20) | B1 | 2 |
| A18 | 0.095 | 49 | 3B (20) | C (20) | B1 | 3 |
| A19 | 0.092 | 48 | 3A (20) | C (20) | B2 | 1 |
| A20 | 0.092 | 39 | 3A (20) | C (20) | B3 | 1 |
| A21 | 0.096 | 52 | 3B (20) | C (20) | B1 | 4 |
| A22 | 0.092 | 32 | 3B (90) | C (10) | B1 | 1 |
| A23 | 0.092 | 36 | 3B (65) | C (10) | B1 | 1 |
| A24 | 0.089 | 30 | 1A (40) | B (50) | B1 | 1 |
| P1 | Measurement infeasible | Measurement infeasible | 1A (100) | Nil | B1 | 1 |
| P2 | Measurement infeasible | Measurement infeasible | 2A (100) | Nil | B1 | 1 |
| P4 | Measurement infeasible | Measurement infeasible | 1B (100) | Nil | B1 | 1 |
| P5 | 0.102 | 70 | 1D (100) | Nil | B1 | 1 |
| P6 | Measurement infeasible | Measurement infeasible | 1A (100) | A (20) | B1 | 1 |
| P7 | Measurement infeasible | Measurement infeasible | 2A (100) | B (15) | B1 | 1 |

TABLE 1-continued

| Environment N/N | | | | | | |
|---|---|---|---|---|---|---|
| Photo-receptor No. | Half decay exposure μJ/cm² | VL (−V) | Charge transport material (Parts by weight) | | Binder | Charge generation material |
| P8 | 0.102 | 63 | 2A (10) | B (15) | B1 | 1 |
| P10 | 0.119 | 143 | D (50) | Nil | B1 | 1 |
| P11 | 0.100 | 89 | E (50) | Nil | B1 | 1 |
| P12 | 0.113 | 70 | F (50) | Nil | B1 | 1 |
| P13 | 0.100 | 79 | G (50) | Nil | B1 | 1 |
| P14 | 0.103 | 62 | C (50) | Nil | B1 | 1 |
| P15 | Measurement infeasible | Measurement infeasible | H (50) | Nil | B1 | 1 |
| P16 | Measurement infeasible | Measurement infeasible | X (50) | Nil | B1 | 1 |

TABLE 2

| Environment L/L | | | | | | |
|---|---|---|---|---|---|---|
| Photo-receptor No. | Half decay exposure μJ/cm² | VL (−V) | Charge transport material (Parts by weight) | | Binder | Charge generation material |
| A7 | 0.115 | 95 | 3A (20) | C (20) | B1 | 1 |
| A10 | 0.111 | 83 | 3A (50) | C (20) | B1 | 1 |
| A15 | 0.119 | 105 | 3B (50) | | B1 | 1 |
| A16 | 0.118 | 110 | 3B (20) | C (20) | B1 | 1 |
| P11 | 0.120 | 125 | E (50) | | B1 | 1 |
| P12 | 0.145 | 132 | F (50) | | B1 | 1 |
| P13 | 0.139 | 130 | G (50) | | B1 | 1 |
| P14 | 0.120 | 115 | C (50) | | B1 | 1 |

TABLE 3

| | |
|---|---|
| Photoreceptor M1 | $5.0 \times 10^{-6}$ (cm²/Vs) |
| Photoreceptor MP1 | $7.2 \times 10^{-6}$ (cm²/Vs) |

It is found from the results shown in Tables that the electrophotographic photoreceptor of the present invention has high sensitivity and low VL and has favorable electric characteristics even under environmental conditions at low temperature under low humidity. Further, it is found to be excellent in miscibility with various binder resins. Further, it is found to be a photoreceptor having very high mobility.

(Image Formation Test, and Test on Stability and Durability of Photoreceptor)

Example 25

To an aluminum tube having a diameter of 30 mm and a length of 254 mm, to the surface of which an anodic oxidation treatment was applied by anodic oxidation in a sulfuric acid aqueous solution and a low temperature sealing treatment was applied in a nickel acetate aqueous solution at 90° C., the coating liquid for formation of charge generation layer and the coating liquid for formation of charge transport layer prepared in the same manner as in Example 7 were sequentially applied by dip coating and dried to prepare an electrophotographic photoreceptor drum with a thickness of the charge generation layer of 0.3 μm and a thickness of the charge transport layer of 25 μm. This drum was mounted on a laser printer Laser Jet 4 (LJ4) manufactured by Hewlett-Packard Japan, Ltd., and an image test was carried out and as a result, a favorable image free from image defects and noises was obtained. Then, 10,000-sheet continuous printing was carried out, but no image deterioration such as ghosts or fogging was observed, and no image defects due to leakage occurred.

Example 26

To an aluminum tube having a diameter of 20 mm and a length of 251 mm, to the surface of which an anodic oxidation treatment was applied by anodic oxidation in a sulfuric acid aqueous solution and a low temperature sealing treatment was applied in a nickel acetate aqueous solution at 90° C., the coating liquid for formation of charge generation layer and the coating liquid for formation of charge transport layer prepared in the same manner as in Example 8 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out at a temperature of 35° C. under a humidity of 85% (hereinafter sometimes referred to as H/H environment) and as a result, a favorable image free from image effects and noises was obtained. Then, 1,000-sheet continuous printing was carried out, but no image deterioration such as leakage, ghosts or fogging was observed, and printing could be carried out stably.

Comparative Example 17

To an aluminum tube having a diameter of 20 mm and a length of 251 mm, to the surface of which an anodic oxidation treatment was applied by anodic oxidation in a sulfuric acid aqueous solution and a low temperature sealing treatment was applied in a nickel acetate aqueous solution at 90° C., the coating liquid for formation of charge generation layer and the coating liquid for formation of charge transport layer prepared in the same manner as in Comparative Example 8 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out under H/H environment and as a result, a favorable image free from image effects and noises was obtained. Then, 1,000-sheet continuous printing was carried out, whereupon image deterioration due to a decrease in the concentration was observed.

Example 27

On an aluminum tube having a diameter of 20 mm and a length of 251 mm, an undercoat layer was formed by a means disclosed in Example 13 in JP-A-2005-99791, and then the coating liquid for formation of charge generation layer and the coating liquid for formation of charge transport layer prepared in the same manner as in Example 8 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out at a temperature of 35° C. under a humidity of 85% (hereinafter sometimes referred to as H/H environment) and as a result, a favorable image free from image effects and noises was obtained. Then, 1,000-sheet continuous printing was carried out, but no image deterioration such as leakage, ghosts, fogging or a decrease in the concentration was observed, and printing could be carried out stably.

Example 28

An electrophotographic photoreceptor A28 was obtained in the same manner as in Example 7 except that the following binder (B4) (viscosity average molecular weight: 70,000, m:n=9:1) was used instead of the binder used in Example 7:

(B4)

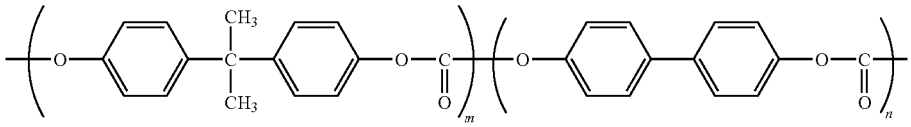

Example 29

An electrophotographic photoreceptor A29 was obtained in the same manner as in Example 7 except that the following binder (B5) (viscosity average molecular weight: 40,000) was used instead of the binder used in Example 7:

(B5)

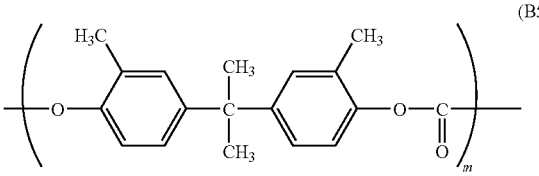

Example 30

An electrophotographic photoreceptor A30 was obtained in the same manner as in Example 7 except that the following binder (B6) (viscosity average molecular weight: 60,000, m:n=6:4) was used instead of the binder used in Example 7:

(B6)

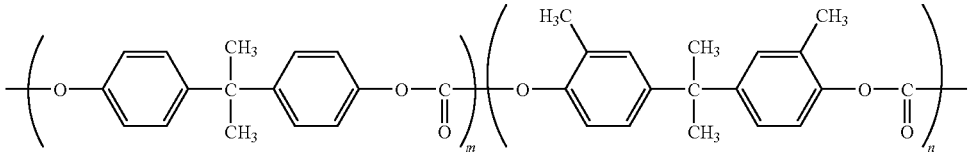

Example 31

An electrophotographic photoreceptor A31 was obtained in the same manner as in Example 1 except that 60 parts by weight of the exemplified compound 15 was used instead of the exemplified compound 1 prepared in Preparation Example (1A) used in Example 1 and that no compound (A) was used.

Example 32

An electrophotographic photoreceptor A32 was obtained in the same manner as in Example 1 except that 30 parts by weight of the exemplified compound 17 was used instead of the exemplified compound 1 prepared in Preparation Example (1A) used in Example 1, and that 30 parts by weight of the compound (A) was used.

Example 33

An electrophotographic photoreceptor A33 was obtained in the same manner as in Example 1 except that 20 parts by weight of the exemplified compound 18 was used instead of the exemplified compound 1 prepared in Preparation Example (1A) used in Example 1.

Example 34

An electrophotographic photoreceptor A34 was obtained in the same manner as in Example 1 except that 30 parts by weight of the exemplified compound 8 was used instead of the exemplified compound 1 prepared in Preparation Example (1A) used in Example 1, and that 30 parts by weight of the exemplified compound 18 was used.

Example 35

An electrophotographic photoreceptor A35 was obtained in the same manner as in Example 1 except that 90 parts by weight of the exemplified compound 15 was 1.0 used instead of the exemplified compound 1 prepared in Preparation Example (1A) used in Example 1 and that no compound (A) was used.

The half decay exposure and VL in environment N/N were measured in the same manner as in the case of the photoreceptors A1 to A24 and P1 to P16. The results are shown in Table 4.

TABLE 4

| Environment N/N | | | | | | |
|---|---|---|---|---|---|---|
| Photo-receptor No. | Half decay exposure μJ/cm² | VL (−V) | Charge transport material (Parts by weight) | | Binder | Charge generation material |
| A28 | 0.092 | 38 | 3A (20) | C (20) | B4 | 1 |
| A29 | 0.095 | 44 | 3A (20) | C (20) | B5 | 1 |
| A30 | 0.093 | 40 | 3A (20) | C (20) | B6 | 1 |
| A31 | 0.089 | 26 | 15 (60) | Nil | B1 | 1 |
| A32 | 0.096 | 43 | 17 (30) | A (30) | B1 | 1 |
| A33 | 0.097 | 53 | 18 (20) | A (20) | B1 | 1 |
| A34 | 0.091 | 38 | 8 (30)<br>18 (30) | A (20) | B1 | 1 |
| A35 | 0.088 | 20 | 15 (90) | Nil | B1 | 1 |

(Printing Evaluation)

Example 36

To an aluminum tube (electroconductive substrate) having a diameter of 30 mm and a length of 254 mm, to the surface of which an anodic oxidation treatment was applied by anodic oxidation in a sulfuric acid aqueous solution and a low temperature sealing treatment was applied in a nickel acetate aqueous solution at 90° C., the coating liquid for formation of charge generation layer used in Example 1 was applied by dip coating and dried so that the thickness would be 0.4 μm after drying to form a charge generation layer. A charge transport layer was formed thereon in the same manner as in Example 31 to prepare an electrophotographic photoreceptor drum. This drum was mounted on a laser printer Laser Jet 4 (LJ4) manufactured by Hewlett-Packard Japan, Ltd., Laser Jet 4 (LJ4) and an image test was carried out and as a result, a favorable image free from image defects and noises was obtained. Then, 10,000-sheet continuous printing was carried out, but no image deterioration such as ghosts or fogging was observed, and no image defects due to leakage occurred.

Example 37

1 kg of a raw slurry obtained by mixing 50 parts of surface-treated titanium oxide obtained by mixing rutile titanium oxide ("TTO55N" manufactured by Ishihara Sangyo Kaisha, Ltd.) having an average primary particle size of 40 nm and methyldimethoxysilane ("TSL8117" manufactured by GE Toshiba Silicones) in an amount of 3 wt % based on the titanium oxide by a Henschel mixer, and 120 parts of methanol, was subjected to dispersion treatment by using zirconia beads (YTZ manufactured by NIKKATO CORPORATION) having a diameter of about 100 μm as a dispersing medium, by using ULTRA APEX MILL (model UAM-015, manufactured by KOTOBUKI INDUSTRIES CO., LTD.) having a mill volume of about 0.15 L at a rotor circumferential speed of 10 m/sec in a liquid-circulating state with a liquid flow rate of 10 kg/hr for one hour to prepare a titanium oxide dispersion liquid.

The above titanium oxide dispersion liquid, a solvent mixture of methanol/1-propanol/toluene, and is pellets of a copolymer polyamide comprising ε-caprolactam (compound represented by the following formula (A))/bis(4-amino-3-methylcyclohexyl)methane (compound represented by the following formula (B))/hexamethylenediamine (compound represented by the following formula (C))/decamethylenedicarboxylic acid (compound represented by the following formula (D))/octadecamethylenedicarboxylic acid (compound represented by the following formula (E)) in a molar ratio of 60%/15%/5%/15%/5% were stirred and mixed with heating to dissolve the polyamide pellets. Then, ultrasonic dispersion treatment by an ultrasonic oscillator at an output of 1,200 W was carried out for one hour, and then the mixture was subjected to filtration with a PTFE membrane filter (Mitex LC manufactured by ADVANTEC) with a pore size of 5 μm, to obtain coating liquid A for formation of undercoat layer containing surface-treated titanium oxide/copolymer polyamide in a weight ratio of 3/1, in a solvent mixture of methanol/1-propanol/toluene in a weight ratio of 7/1/2 at a concentration of solid content contained of 18.0 wt %:

A

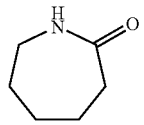

B

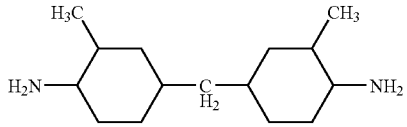

C

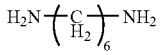

D

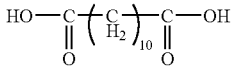

E

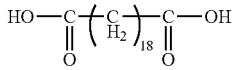

The coating liquid A for formation of undercoat layer was applied to an aluminum cut tube having a diameter of 30 mm, a length of 285 mm and a thickness of 0.8 mm by dip coating so that the thickness would be 2.4 μm after drying and dried to form an undercoat layer. The surface of the undercoat layer was observed by a scanning electron microscope, whereupon substantially no agglomerates were observed. On the undercoat layer, a charge generation layer and a charge transport layer were formed in the same manner as in Example 36.

The prepared photoreceptor was set to a cartridge of a color printer manufactured by Seiko Epson Corporation (tradename: InterColor LP-1500C) to form a full color image, whereupon a favorable image was obtained.

Example 41

10 Parts by weight of the oxytitanium phthalocyanine obtained in Example 1 for preparation of charge generation material and 150 parts by weight of 4-methoxy-4-methyl-2-pentanone were mixed, followed by grinding and dispersion treatment by a sand grinding mill for one hour to prepare a pigment dispersion liquid.

Further, 100 parts by weight of a 1,2-dimethoxyethane solution of polyvinyl butyral (Denka Butyral #6000C, tradename, manufactured by Denki Kagaku Kogyo Kabushiki Kaisha) at a concentration of 5 wt % and 100 parts by weight of a 1,2-dimethoxyethane solution of a phenoxy resin (PKHH, tradename, manufactured by Union Carbide) at a concentration of 5 wt % were mixed to prepare a binder resin solution.

160 Parts by weight of the above prepared pigment dispersion liquid, 100 parts by weight of the binder resin solution and a proper amount of 1,2-dimethoxyethane were mixed to prepare a coating liquid for formation of charge generation layer having a final solid content concentration of 4.0%.

The obtained dispersion liquid for formation of charge generation layer was applied to a polyethylene terephthalate film in a thickness of 75 μm having aluminum vapor deposited on its surface so that the film thickness would be 0.3 μm after drying to provide a charge generation layer.

Then, to the film, a liquid having 40 parts by weight of the exemplified compound 3 prepared in Preparation Example (3A), 100 parts by weight of polyarylate (BA1) having the following structure (viscosity average molecular weight: 40,000):

(BA1)

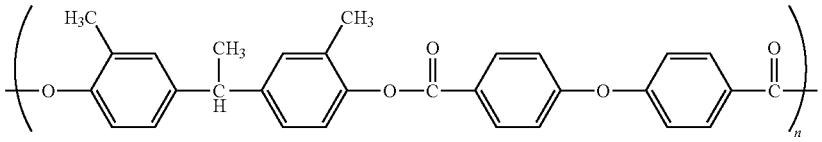

and 0.03 part by weight of a silicone oil as a leveling agent dissolved in 640 parts by weight of THF/toluene=8/2 (mixing weight ratio) (hereinafter sometimes referred to as a coating liquid for formation of charge transport layer) was applied and dried at 125° C. for 20 minutes to provide a charge transport layer so that the film thickness would be 20 μm after drying thereby to obtain an electrophotographic photoreceptor A41.

Example 42

An electrophotographic photoreceptor A42 was obtained in the same manner as in Example 41 except that polyarylate (BA2) having the following structure (viscosity average molecular weight: 40,000, n:m=1:1) was used instead of the polyarylate (BA1) used in Example 41:

(BA2)

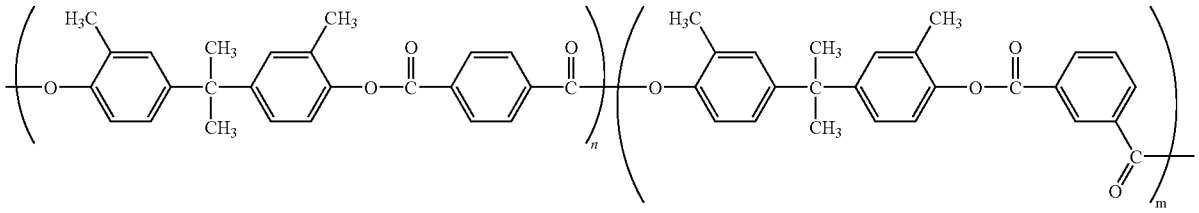

Example 43

An electrophotographic photoreceptor A43 was obtained in the same manner as in Example 41 except that a polyarylate resin (BA3) having the following structure (viscosity average molecular weight: 40,000, n:m=7:3) was used instead of the polyarylate (BA2) used in Example 42:

(BA3)

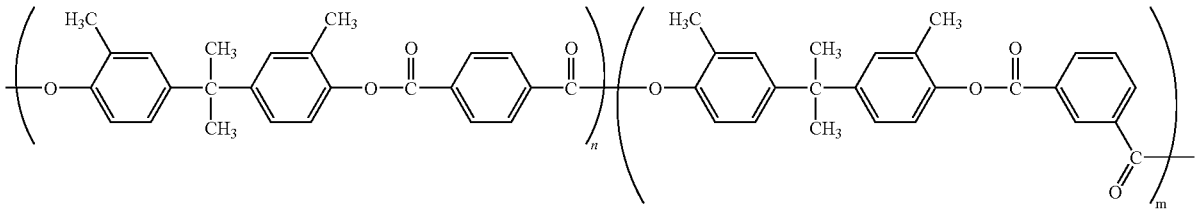

Example 44

An electrophotographic photoreceptor A44 was obtained in the same manner as in Example 1 except that a polyarylate resin (BA4) having the following structure (viscosity average molecular weight: 40,000, n:m=7:3) was used instead of the binder (BA1) used in Example 41:

(BA4)

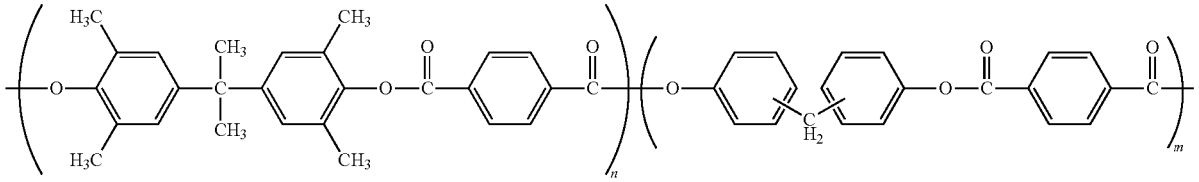

Example 45

An electrophotographic photoreceptor A45 was obtained in the same manner as in Example 41 except that the exemplified compound 3 prepared in Preparation Example (3B) was used instead of the exemplified compound 3 prepared in Preparation Example (3A) used in Example 41.

Example 46

An electrophotographic photoreceptor A46 was obtained in the same manner as in Example 41 except that 20 parts by weight of the exemplified compound 2 prepared in Preparation Example (2A) was used instead of the exemplified compound 3 prepared in Preparation Example (3A) used in Example 41 and that 20 parts by weight of the compound (A) was used.

Example 47

An electrophotographic photoreceptor A47 was obtained in the same manner as in Example 46 except that the exemplified compound 2 prepared in Preparation Example (2B) was used instead of the exemplified compound 2 prepared in Preparation Example (2A) used in Example 46.

Example 48

An electrophotographic photoreceptor A48 was obtained in the same manner as in Example 41 except that 40 parts by weight of the exemplified compound 1 prepared in Preparation Example (1A) was used instead of the exemplified compound 3 prepared in Preparation Example (3A) used in Example 41 and that 20 parts by weight of the compound (C) was used.

Example 49

An electrophotographic photoreceptor A49 was obtained in the same manner as in Example 48 except that the exemplified compound 1 prepared in Preparation Example (1B) was used instead of the exemplified compound 1 prepared in Preparation Example (1A) used in Example 48.

Example 50

An electrophotographic photoreceptor A50 was obtained in the same manner as in Example 41 except that the charge generation material 2 prepared in Example 2 for preparation of charge generation material was used instead of the charge generation material 1 prepared in Example 1 for preparation of charge generation material used in Example 41.

Example 51

An electrophotographic photoreceptor A51 was obtained in the same manner as in Example 41 except that the charge generation material 3 prepared in Example 3 for preparation of charge generation material was used instead of the charge generation material 1 prepared in Example 1 for preparation of charge generation material used in Example 41.

Example 52

An electrophotographic photoreceptor A52 was obtained in the same manner as in Example 41 except that 50 parts by weight of the polyarylate (BA1) used in Example 41 was used and that 50 parts by weight of the polycarbonate (B3) (viscosity average molecular weight: 40,000, m:n=9:1) (the binder resin (B3)) was used.

Example 53

An electrophotographic photoreceptor A53 was obtained in the same manner as in Example 41 except that the charge generation material 4 was used instead of the oxytitanium phthalocyanine obtained in Example 1 for preparation of charge generation material used in Example 41.

Comparative Example 27

An electrophotographic photoreceptor P27 was obtained in the same manner as in Example 41 except that the compound (C) was used instead of the exemplified compound 3 prepared in Preparation Example (3A) used in Example 41.

Comparative Example 28

An electrophotographic photoreceptor P28 was obtained in the same manner as in Example 41 except that the compound (E) was used instead of the exemplified compound 3 prepared in Preparation Example (3A) used in Example 41.

Comparative Example 29

An electrophotographic photoreceptor P29 was obtained in the same manner as in Example 41 except that the compound (F) was used instead of the exemplified compound 3 prepared in Preparation Example (3A) used in Example 41.

Comparative Example 30

An electrophotographic photoreceptor P30 was obtained in the same manner as in Example 41 except that the compound (G) was used instead of the exemplified compound 3 prepared in Preparation Example (3A) used in Example 41.

Comparative Example 31

It was attempted to obtain an electrophotographic photoreceptor P31 in the same manner as in Example 41 except that the compound (H) was used instead of the exemplified compound 3 prepared in Preparation Example (3A) used in Example 41, but deposition was confirmed on the photoreceptor, and the characteristics could not be evaluated.

Comparative Example 32

An electrophotographic photoreceptor P32 was obtained in the same manner as in Example 41 except that the charge transport material X prepared in Comparative Preparation Example 1 was used instead of the exemplified compound 3 prepared in Preparation Example (3A) used in Example 41.

Electric characteristics of the photoreceptors were evaluated, and the half decay exposure and VL were measured, in the same manner as in the case of the photoreceptors A1 to A24 and P1 to P16. The results are shown in Table 5 (environment N/N) and Table 6 (environment L/L).

TABLE 5

| Environment N/N | | | | | | |
|---|---|---|---|---|---|---|
| Photo-receptor No. | Half decay exposure μJ/cm² | VL (−V) | Charge transport material (Parts by weight) | | Binder | Charge generation material |
| A41 | 0.094 | 50 | 3A (40) | Nil | BA1 | 1 |
| A42 | 0.095 | 53 | 3A (40) | Nil | BA2 | 1 |
| A43 | 0.094 | 55 | 3A (40) | Nil | BA3 | 1 |
| A44 | 0.100 | 55 | 3A (40) | Nil | BA4 | 1 |
| A45 | 0.092 | 44 | 3B (40) | Nil | BA1 | 1 |
| A46 | 0.091 | 40 | 2A (20) | A (20) | BA1 | 1 |
| A47 | 0.093 | 29 | 2B (20) | A (20) | BA1 | 1 |
| A48 | 0.093 | 29 | 1A (40) | C (20) | BA1 | 1 |
| A49 | 0.095 | 41 | 1B (40) | C (20) | BA1 | 1 |
| A50 | 0.094 | 45 | 3A (40) | Nil | BA1 | 2 |
| A51 | 0.092 | 43 | 3A (40) | Nil | BA1 | 3 |
| A52 | 0.094 | 41 | 3A (40) | Nil | BA1/B3 | 1 |
| A53 | 0.096 | 52 | 3A (40) | Nil | BA1 | 4 |
| P27 | 0.102 | 60 | C (40) | Nil | BA1 | 1 |
| P28 | 0.100 | 89 | E (40) | Nil | BA1 | 1 |
| P29 | 0.113 | 70 | F (40) | Nil | BA1 | 1 |
| P30 | 0.100 | 79 | G (40) | Nil | BA1 | 1 |
| P32 | 0.103 | 63 | X (40) | Nil | BA1 | 1 |

It is found from the results shown in Table 5 that the electrophotographic photoreceptor of the present invention has high sensitivity and low VL and has favorable electric characteristics. Further, it is found to be excellent in miscibility with various binders.

TABLE 6

| Environment L/L | | | | | | |
|---|---|---|---|---|---|---|
| Photo-receptor No. | Half decay exposure μJ/cm² | VL (−V) | Charge transport material (Parts by weight) | | Binder | Charge generation material |
| A47 | 0.115 | 95 | 2B (20) | A (20) | BA1 | 1 |
| A48 | 0.111 | 83 | 1A (40) | B (20) | BA1 | 1 |
| A49 | 0.119 | 105 | 1B (40) | B (20) | BA1 | 1 |
| A50 | 0.118 | 110 | 3A (40) | Nil | BA1 | 2 |
| P28 | 0.120 | 121 | E (40) | Nil | BA1 | 1 |
| P29 | 0.145 | 132 | F (40) | Nil | BA1 | 1 |

TABLE 6-continued

| Environment L/L | | | | | | |
|---|---|---|---|---|---|---|
| Photo-receptor No. | Half decay exposure μJ/cm² | VL (−V) | Charge transport material (Parts by weight) | | Binder | Charge generation material |
| P30 | 0.139 | 130 | G (40) | Nil | BA1 | 1 |
| P32 | 0.120 | 115 | X (40) | Nil | BA1 | 1 |

It is found from the results shown in Table 6 that the electrophotographic photoreceptor of the present invention has high sensitivity and low VL and has favorable electric characteristics even in environmental conditions at low temperature under low humidity. Further, it is found to be excellent in miscibility with various binder resins.

(Image Formation Test, and Test on Stability and Durability of Photoreceptor)

Example 54

To an aluminum tube having a diameter of 30 mm and a length of 254 mm, to the surface of which an anodic oxidation treatment and a sealing treatment were applied, the coating liquid for formation of charge generation layer and the coating liquid for formation of charge transport layer prepared in the same manner as in Example 47 were sequentially applied by dip coating and dried to prepare an electrophotographic photoreceptor drum with a thickness of the charge generation layer of 0.3 μm and a thickness of the charge transport layer of 25 μm. This drum was mounted on a laser printer Laser Jet 4 (LJ4) manufactured by Hewlett-Packard Japan, Ltd., and an image test was carried out and as a result, a favorable image free from image defects and noises was obtained. Then, 10,000-sheet continuous printing was carried out, but no image deterioration such as ghosts or fogging was observed, and no image defects due to leakage occurred.

Example 55

To an aluminum tube having a diameter of 20 mm and a length of 251 mm, to the surface of which an anodic oxidation treatment and a sealing treatment were applied, the coating liquid for formation of charge generation layer and the coating liquid for formation of charge transport layer prepared in the same manner as in Example 48 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out at a temperature of 35° C. under a humidity of 85% (hereinafter sometimes referred to as H/H environment) and as a result, a favorable image free from image effects and noises was obtained. Then, 1,000-sheet continuous printing was carried out, but no image deterioration such as leakage, ghosts or fogging was observed, and printing could be carried out stably.

Comparative Example 33

To an aluminum tube having a diameter of 20 mm and a length of 251 mm, to the surface of which an anodic oxidation treatment and a sealing treatment were applied, the coating liquid for formation of charge generation layer and the coating liquid for formation of charge transport layer prepared in the same manner as in Comparative Example 28 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out is H/H environment and as a result, a favorable image free from image effects and noises was obtained. Then, 1,000-sheet continuous printing was carried out, whereupon image deterioration due to fogging was observed.

Example 56

On an aluminum tube having a diameter of 20 mm and a length of 251 mm, an undercoat layer was formed by a means disclosed in Example 13 in JP-A-2005-99791. Then, the coating liquid for formation of charge generation layer and the coating liquid for formation of charge transport layer prepared in the same manner as in Example 48 were sequentially applied by dip coating and dried to prepare an electrophotographic photoreceptor drum with a thickness of the charge generation layer of 0.3 μm and a thickness of the charge transport layer of 15 μm. Four such drums were mounted on a tandem color laser printer C1616 manufactured by Fuji Xerox Co., Ltd., and an image test was carried out at a temperature of 35° C. under a humidity of 85% (hereinafter sometimes referred to as H/H environment) and as a result, a favorable image free from image effects and noises was obtained. Then, 1,000-sheet continuous printing was carried out, but no image deterioration such as leakage, ghosts, fogging or a decrease in the concentration was observed, and printing could be carried out stably.

(Evaluation of Mobility)

The mobility of the charge transport layer of each of the obtained photoreceptors A41 and A44 was measured in the same manner as in the case of the electrophotographic photoreceptors M1 and MP1 in accordance with TOF method by charge generation material excitation by exposure at 780 nm at 21±0.5° C. at $2.0\times10^5$ (V/cm). The results are shown in Table 7.

TABLE 7

| Photoreceptor No. | Mobility |
|---|---|
| A41 | $4.2\times10^{-6}$ ($cm^2$/Vs) |
| A44 | $4.6\times10^{-6}$ ($cm^2$/Vs) |

Example 57

An electrophotographic photoreceptor A57 was obtained in the same manner as in Example 41 except that 40 parts by weight of the exemplified compound 15 was used instead of the exemplified compound 3 prepared in Preparation Example (3A) used in Example 41 and that no compound (A) was used.

Example 58

An electrophotographic photoreceptor A58 was obtained in the same manner as in Example 41 except that 40 parts by weight of the exemplified compound 16 was used instead of the exemplified compound 3 prepared in Preparation Example (3A) used in Example 41 and that no compound (A) was used.

Example 59

An electrophotographic photoreceptor A59 was obtained in the same manner as in Example 41 except that 40 parts by weight of the exemplified compound 18 was used instead of the exemplified compound 3 prepared in Preparation Example (3A) used in Example 41 and that no compound (A) was used.

The electric characteristics of the photoreceptors were evaluated, and the half decay exposure and VL in environment N/N were measured, in the same manner as in the case of the photoreceptors A1 to A24 and P1 to P16. The results are shown in Table 8.

TABLE 8

| Environment N/N | | | | | | |
|---|---|---|---|---|---|---|
| Photoreceptor No. | Half decay exposure μJ/$cm^2$ | VL (−V) | Charge transport material (Parts by weight) | | Binder | Charge generation material |
| A57 | 0.093 | 34 | 15 (40) | Nil | BA1 | 1 |
| A58 | 0.096 | 46 | 16 (40) | Nil | BA1 | 1 |
| A59 | 0.095 | 44 | 18 (40) | Nil | BA1 | 1 |

It is found from the results shown in Table 8 that the electrophotographic photoreceptor of the present invention has high sensitivity and low VL and has favorable electric characteristics.

Example 60

On a cylinder made of an aluminum alloy having an outer diameter of 30 mm, a length of 244 mm and a thickness of 0.75 mm, an undercoat layer was formed by a means disclosed in Example 13 in JP-A-2005-099791 by dip coating so that the thickness would be 1.0 μm after drying, following by drying.

Then, 5 parts by weight of the charge generation material 4 together with 70 parts by weight of toluene was dispersed by a sand grinding mill to obtain a dispersion liquid. In the same manner, 8 parts by weight of a charge transport material having the following structure together with 112 parts by weight of toluene was dispersed by a sand grinding mill to obtain a dispersion liquid. Separately, 30 parts by weight of the exemplified compound 3 prepared in Preparation Example 3A, 30 parts by weight of the compound (A) used in Example 1, 100 parts by weight of the binder resin (B1), 8 parts by weight of an antioxidant (IRGANOX1076, tradename, manufactured by Ciba Geigy) and 0.05 part of a silicone oil as a leveling agent were dissolved in 420 parts by weight of toluene, and the obtained solution and the above two dispersion liquids were mixed by a homogenizer. The coating liquid thus prepared was applied to the above undercoat layer by dip coating so that the thickness would be 25 μm after drying to obtain a positively charged monolayer type electrophotographic photoreceptor A60:

(Electron Transport Material)

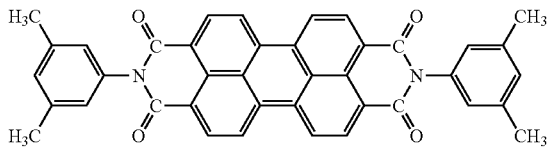

(Evaluation of Electric Characteristics)

By using an electrophotographic characteristic evaluation apparatus (described on pages 404 to 405 in "Electrophotography—Bases and applications, second series" edited by the Society of Electrophotography, Published by Corona Co.), manufactured in accordance with the measurement standard by the Society of Electrophotography, a test was carried out in the following manner. The photoreceptor drum was rotated at a constant number of revolution of 60 rpm to perform the electric characteristic evaluation test by cycles of charging, exposure, potential measurement and charge removal. In this step, the photoreceptor was charged so that the initial surface potential would be +900 V, and the surface potential after exposure (hereinafter sometimes referred to as $VL^+$) upon exposure with a 780-nm monochromatic light converted from a light from a halogen lamp through an interference filter at 1.0 $\mu J/cm^2$, was measured. For the $VL^+$ measurement, the time required from exposure to potential measurement was set at 100 ms. The measurements were carried out under the environment at a temperature of 25° C. under a relative humidity of 50%.

As a result, $VL^+$ was +65 V, which is a sufficiently low surface potential, and the photoreceptor was found to be very suitable as a photoreceptor for electrophotography.

(Image Formation Test)

The electrophotographic photoreceptor A60 was set to a drum cartridge (DR510) of a commercially available laser printer HL-5140 (manufactured by Brother Industries, Ltd.) which is used as positively charged, to form a half tone image, whereupon the difference in concentration with an image using a standard drum (genuine product for DR510) and presence or absence of black spots were confirmed.

As a result, the image concentration was equal to that when a standard drum was used, no black spots occurred, and it was found that the photoreceptor properly operates as an image forming apparatus.

Industrial Applicability

According to the present invention, a charge transport material having a specific structure excellent in electric characteristics and other various characteristics is found, and formation of an electrophotographic photoreceptor having improved electric characteristics, stability and durability by using it becomes possible. Such an electrophotographic photoreceptor can be used for an image forming apparatus and an electrophotographic cartridge.

The entire disclosures of Japanese Patent Application No. 2005-282810 filed on Sep. 28, 2005 and Japanese Patent Application No. 2005-282811 filed on Sep. 28, 2005 including specifications, claims, drawings and summaries are incorporated herein by reference in their entireties.

The invention claimed is:

1. An electrophotographic photoreceptor comprising an electroconductive substrate and a photosensitive layer formed theron, wherein the photosensitive layer comprises a compound represented by the following formula (1), the ratio of the weight of the compound represented by the formula (1) to the weight content of all binder resins contained in the photosensitive layer is from 0.15 to 0.6:

(1)

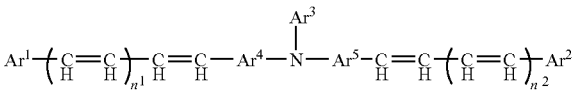

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1) is composed of various component parts labeled as (a) through (d) as shown in the following formula (2):

(2)

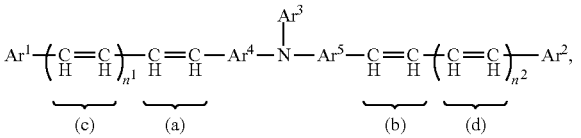

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

2. The electrophotographic photoreceptor according to claim 1, wherein the photosensitive layer comprises oxytitanium phthalocyanine.

3. The electrophotographic photoreceptor according to claim 1, wherein the photosensitive layer comprises an antioxidant.

4. The electrophotographic photoreceptor according to claim 2, wherein the oxytitanium phthalocyanine is crystalline oxytitanium phthalocyanine showing a peak at a Bragg angle (2θ±0.2°) of 27.3° in an X-ray diffraction spectrum by CuKα ray.

5. The electrophotographic photoreceptor according to claim 1, wherein the ratio of the weight content of the compound represented by the formula (1) to the weight content of all charge transport material contained in the photosensitive layer is 0.25 to 1.

6. An image forming apparatus comprising the electrophotographic photoreceptor as defined in claim 1.

7. An electrophotographic cartridge having the electrophotographic photoreceptor as defined in claim 1.

8. An electrophotographic photoreceptor comprising an electroconductive substrate and a photosensitive layer formed thereon, wherein the photosensitive layer comprises a compound represented by the following formula (1), the ratio of the weight of the compound represented by the formula (1) to the weight content of all binder resins contained in the photosensitive layer is from 0.15 to 0.9, and the photosensitive layer contains oxytitanium phthalocyanine:

(1)

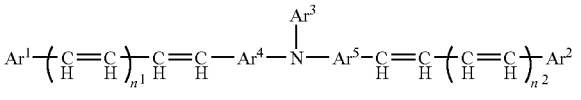

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1)is composed of various component parts labeled as (a) through (d) as shown in the following formula (2):

(2)

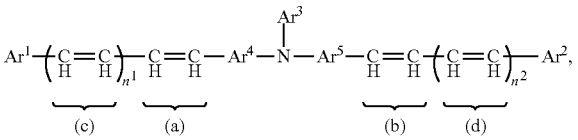

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

9. An electrophotographic photoreceptor comprising an electroconductive substrate and a photosensitive layer formed thereon, wherein the photosensitive layer comprises a compound represented by the following formula (1), and the photosensitive layer comprises oxytitanium phthalocyanine:

(1)

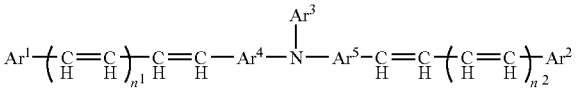

wherein each of $Ar^1$ and $Ar^2$ is an aryl group which may have a substituent, $Ar^3$ is an aryl group having an plurality of alkyl substituents, wherein one of the alkyl substituents is a group of at least two carbon atoms, each of $Ar^4$ and $Ar^5$ which are independent of each other, is an arylene group which may have a substituent, and each of $n^1$ and $n^2$ is 1, wherein the compound represented by formula (1)is composed of various component parts labeled as (a) through (d) as shown in the following formula (2):

(2)

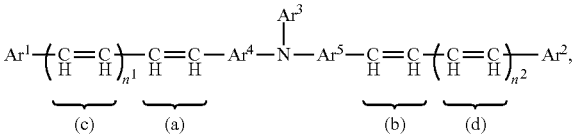

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

10. An electrophotographic photoreceptor comprising an electroconductive substrate and a photosensitive layer formed thereon, wherein the photosensitive layer comprises a compound represented by the following formula (1) , and the photosensitive layer comprises oxytitanium phthalocyanine:

(1)

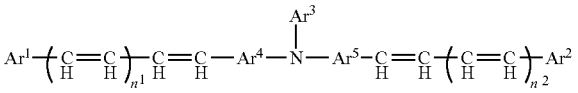

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1) is composed of various component parts labeled as (a) through (d) as shown in the following formula (2):

(2)

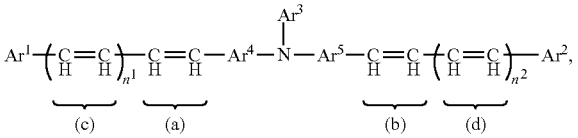

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

11. The electrophotographic photoreceptor according to claim 10, wherein $Ar^3$ in the compound represented by the formula (1) has a branched alkyl group as a substituent.

12. An electrophotographic photoreceptor comprising an electroconductive substrate and a photosensitive layer formed thereon, wherein the photosensitive layer comprises a compound represented by the following formula (1) and a polyarylate:

(1)

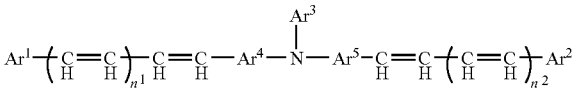

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1) is composed of various component parts labeled as (a) through (d) as shown in the following formula (2):

(2)

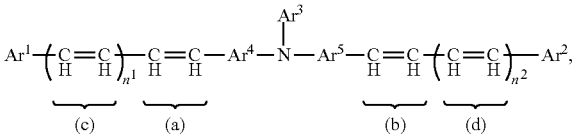

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

13. The electrophotographic photoreceptor according to claim 12, wherein the ratio of the weight of the compound represented by the formula (1) to the weight content of all binder resins in the photosensitive layer is from 0.15 to 0.9.

14. The electrophotographic photoreceptor according to claim 12, wherein the photosensitive layer further comprises oxytitanium phthalocyanine.

15. An electrophotographic photoreceptor comprising an electroconductive substrate and a photosensitive layer formed thereon, wherein the photosensitive layer comprises a compound represented by the following formula (1) and a polycarbonate having the following structural units (p-1):

(1)

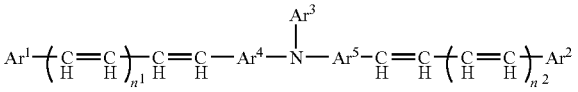

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, (p-1)

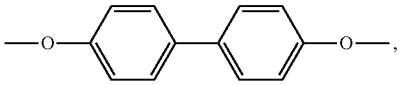

wherein the compound represented by formula (1) is composed of various component parts labeled as (a) through (d) as shown in the following formula (2):

(2)

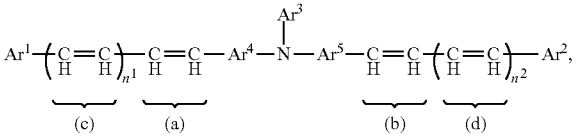

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

16. The electrophotographic photoreceptor according to claim 15, wherein the ratio of the weight of the compound represented by the formula (1) to the weight content of all binder resins in the photosensitive layer is from 0.15 to 0.9.

17. An electrophotographic photoreceptor comprising an electroconductive substrate and a photosensitive layer formed thereon, wherein the photosensitive layer comprises a compound represented by the following formula (1) and a polycarbonate having the following structural units (p-2), and the ratio of the weight of the compound represented by the formula (1) to the weight content of all binder resins in the photosensitive layer is from 0.15 to 0.9;

(1)

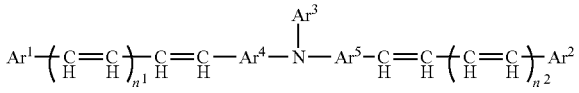

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, (p-2)

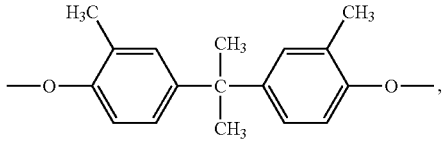

wherein the compound represented by formula (1) is composed of various component parts labeled as (a) through (d) as shown in the following formula (2):

(2)

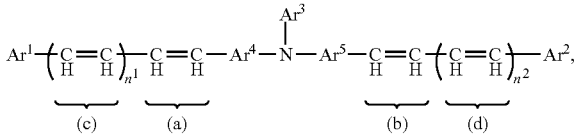

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

18. An electrophotographic photoreceptor comprising an electroconductive substrate and a photosensitive layer formed thereon, wherein the photosensitive layer comprises a compound represented by the following formula (1), and the electroconductive substrate is made of aluminum or an aluminum alloy and has an anodic oxide film:

(1)

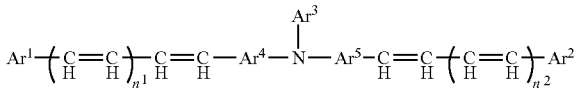

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1) is composed of various component parts labeled as (a) through (d) as shown in the following formula (2):

(2)

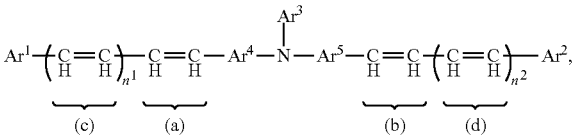

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

19. An electrophotographic photoreceptor comprising an electroconductive substrate and a photosensitive layer formed thereon, wherein the photosensitive layer comprises a compound represented by the following formula (1) , and an undercoat layer is provided between the electroconductive substrate and the photosensitive layer:

(1)

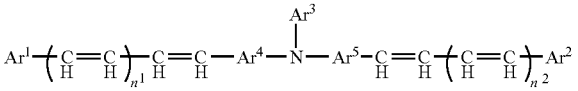

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by formula (1) is composed of various component parts labeled as (a) through (d) as shown in the following formula (2):

(2)

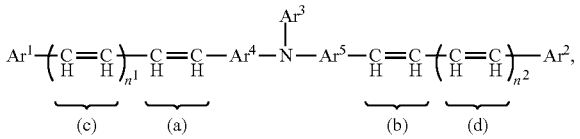

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

20. An electrophotographic photoreceptor comprising an electroconductive substrate and a photosensitive layer formed thereon, wherein the photosensitive layer comprises a compound represented by the following formula (1) and a charge transport material represented by the following formula (r):

(1)

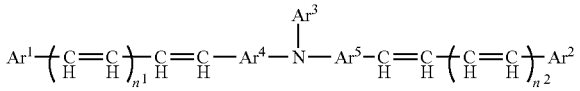

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, (r)

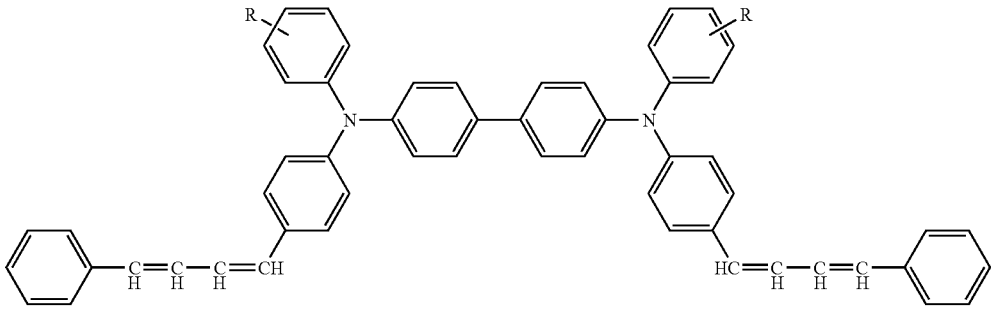

wherein each of R's which may be different from each other, is a hydrogen atom, an alkyl group, an alkoxy group or a phenyl group, wherein the compound represented by the formula (1) is composed of various component parts labeled as (a) through (d) as shown in the following formula (2):

(2)

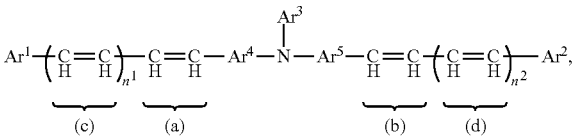

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

21. An electrophotographic photoreceptor comprising an electroconductive substrate and a photosensitive layer formed thereon, wherein the photosensitive layer comprises a compound represented by the following formula (1) and at least one charge transport material selected from the group consisting of compounds of the following formulae (p) and (q), and the ratio of the weight of the compound represented by the formula (1) to the weight content of all binder resins in the photosensitive layer is from 0.15 to 0.9:

(1)

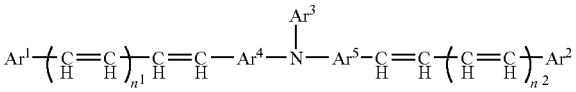

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, (p)

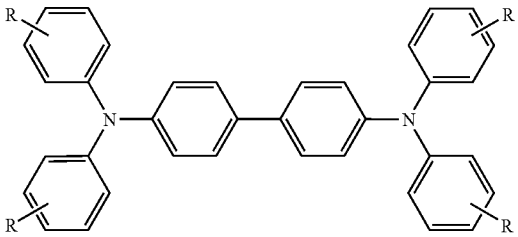

(q)

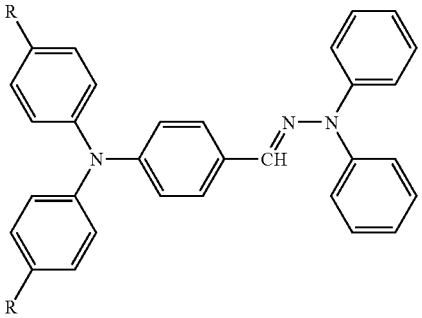

wherein each of R's which may be different from each other, is a hydrogen atom, an alkyl group, an alkoxy group or a phenyl group, wherein the compound represented by the formula (1) is composed of various component parts labeled as (a) through (d) as shown in the following formula (2):

(2)

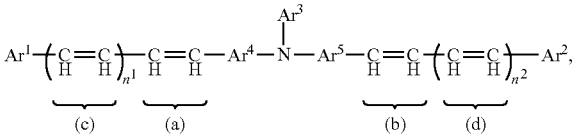

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

22. An electrophotographic photoreceptor comprising an electroconductive substrate and a photosensitive layer formed thereon, wherein the photosensitive layer comprises a compound represented by the following formula (1), and the electrophotographic photoreceptor is charged by a charger of contact charging system:

(1)

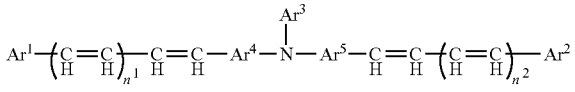

wherein each of $Ar^1$ and $Ar^2$ is an aryl group which may have a substituent, $Ar^3$ is an aryl group having an alkyl group of at least two carbon atoms as a substituent, each of $Ar^4$ and $Ar^5$ which are independent of each other, is an arylene group which may have a substituent, and each of $n^1$ and $n^2$ is 1, wherein the compound represented by the formula (1) is composed of various component parts labeled as (a) through (d) as shown in the following formula (2):

(2)

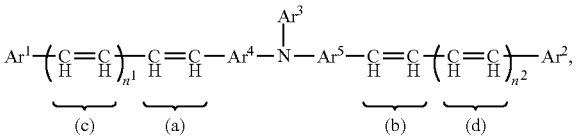

wherein in formula (2), the proportion of a trans-form in (a) is at least 70 mol % and the proportion of a trans-form in (b) is at least 70 mol %, and the proportion of a trans-form in (c) is at least 90 mol % and the proportion of a trans-form in (d) is at least 90 mol %.

23. The electrophotographic photoreceptor according to claim 22, wherein the ratio of the weight content of the compound represented by the formula (1) to the weight content of all binder resins in the photosensitive layer is from 0.15 to 0.9.

* * * * *